US010753603B2

(12) United States Patent
Yoo

(10) Patent No.: US 10,753,603 B2
(45) Date of Patent: Aug. 25, 2020

(54) MONITORING SYSTEM FOR STEAM GENERATING DEVICE MOUNTED WITH DISPLAY

(71) Applicant: SJE Corporation, Ltd., Busan (KR)

(72) Inventor: Ho Moog Yoo, Busan (KR)

(73) Assignee: SJE CORPORATION, LTD., Busan (KR)

( * ) Notice: Subject to any disclaimer, the term of this patent is extended or adjusted under 35 U.S.C. 154(b) by 137 days.

(21) Appl. No.: 16/134,229

(22) Filed: Sep. 18, 2018

(65) Prior Publication Data

US 2019/0285270 A1 Sep. 19, 2019

(30) Foreign Application Priority Data

Mar. 14, 2018 (KR) ..... 10-2018-0029613

(51) Int. Cl.
*F22B 37/42* (2006.01)
*F22B 37/38* (2006.01)
*F22B 37/78* (2006.01)

(52) U.S. Cl.
CPC ..... *F22B 37/42* (2013.01); *F22B 37/38* (2013.01); *F22B 37/78* (2013.01)

(58) Field of Classification Search
CPC ..... F22B 37/42
See application file for complete search history.

(56) References Cited

U.S. PATENT DOCUMENTS

| | | | | |
|---|---|---|---|---|
| 5,810,977 | A * | 9/1998 | Annecharico | B01D 1/0017 122/130 |
| 2010/0153030 | A1* | 6/2010 | Yatir | F24H 9/0021 702/55 |
| 2011/0044671 | A1* | 2/2011 | Amiran | F24D 17/0031 392/441 |
| 2012/0204815 | A1* | 8/2012 | Yoo | F23L 15/04 122/235.23 |
| 2017/0315697 | A1* | 11/2017 | Jacobson | G06F 16/26 |
| 2018/0271322 | A1* | 9/2018 | Thai | A47J 31/002 |

FOREIGN PATENT DOCUMENTS

| | | |
|---|---|---|
| JP | 06288504 | 10/1994 |
| KR | 20090079486 | 7/2009 |
| KR | 101187929 | 10/2012 |
| KR | 20140037565 | 3/2014 |
| KR | 101386208 | 4/2014 |
| KR | 20170045724 | 4/2017 |
| KR | 101797384 | 11/2017 |

* cited by examiner

*Primary Examiner* — Nathaniel Herzfeld
(74) *Attorney, Agent, or Firm* — Cantor Colburn LLP

(57) ABSTRACT

Provided is a system, in which a display is mounted to a steam generating device to monitor a driving situation or an erroneous operation situation of the steam generating device through the display. It is possible to monitor an operation situation of a steam generating device through a simple screen configuration in real time at a glance, and enable a user to diversely analyze reasons by various factors when an abnormal operation is generated and cope with the abnormal operation.

3 Claims, 28 Drawing Sheets

701

701a

703

MONITORING SYSTEM FOR STEAM GENERATING DEVICE MOUNTED WITH DISPLAY

TECHNICAL FIELD

The present invention relates to a system, in which a display is mounted to a steam generating device to monitor a driving situation or an erroneous operation situation of the steam generating device through the display.

BACKGROUND ART

A related art for a steam generating device is variously disclosed in Korean Patent No. 10-1797384, Korean Patent Application Laid-Open No. 10-2009-0079486, and the like, and most of the inventions have been derived while focusing on an operational scheme or a structural characteristic in order to improve thermal efficiency of the steam generating devices, so that the inventions do not present the configuration of monitoring an operation situation of the steam generating device in real time or preparing a problem situation on an assumption of the problem situation.

In the meantime, Korean Patent No. 10-1187929 discloses a steam generating device including: a water level detecting unit, which detects a water level within a steam tank; a pressure switch, which measures pressure within the steam tank; a temperature sensor, which measures a temperature within the steam tank; and a controller, which controls on/off of power of a water supply pump according to a water level detected by the water level detecting unit, and controls on/off of power applied to electric heaters of a preheating tank and the steam tank according to the temperature measured by the temperature sensor, to monitor the steam generating device by the controller.

However, in the steam generating device, a characteristic of the steam generating device, in which each configuration is organically operated, is not reflected, and each measurement element is individually determined and only a fragmentary action is taken, so that it is not easy to recognize a reason of an erroneous operation and there is a limit in preventing an erroneous operation situation.

RELATED ART LITERATURE

Patent Document (Patent Document 1) Korean Patent No. 10-1187929 (Sep. 26, 2012)

(Patent Document 2) Korean Patent No. 10-1386208 (Apr. 10, 2014)

SUMMARY OF THE INVENTION

The present invention has been made in an effort to provide a monitoring system for a steam generating device, which is capable of monitoring an operation situation of a steam generating device through a simple screen configuration in real time at a glance, and is capable of enabling a user to diversely analyze reasons caused by various factors when an abnormal operation is generated and cope with the abnormal operation.

An exemplary embodiment of the present invention provides a monitoring system for a steam generating device mounted with a display, the monitoring system including: a water tank 110, which is provided with a water level sensor 110 which measures a water level of stored water; a burner

400, which generates heat; a boiler tank 300, which receives water from the water tank 100 and receives heat by the burner 400 to generate steam, and is provided with a water level sensor 310 measuring a water level of supplied water, a pump 320 supplying water from the water tank 100, a thermistor 330 measuring an internal temperature, a pressure switch 340 measuring an internal pressure, and an air purge 350 discharging condensed air inside a boiler when a temperature measured by the thermistor 330 is equal to or lower than a reference temperature; and a display 700, on which a screen monitoring driving situations of the water tank 100, the boiler tank 300, and the burner 400 is output, in which the burner 400 is a burner generating heat by combustion of fuel or a heater generating heat by electricity, the water level sensor 310 is formed of a high-water level sensor 311 and a low-water level sensor 312 vertically disposed inside the boiler tank 300, the display 700 includes: a standby screen 701 output in a standby state, in which power is applied to the steam generating device 10 and the system is not booted; and a driving screen 702 output in a driving state, in which power is applied to the steam generating device 10 and the system is booted, the driving screen 702 includes: a water tank state output section 710 outputting a water charging state of the water tank according to the water level sensor 110 of the water tank; a boiler state output section 730 outputting a water charging state of the boiler tank according to the water level sensor 310 of the boiler tank and outputting an error state when an abnormal state is detected by the water level sensor 310 or the thermistor 330 of the boiler tank; a combustion state output section 740 outputting a state of the burner 400, and outputting an error state when an abnormal state is detected by the pressure switch 340 of the boiler tank; and a message output section 750 outputting a message or an error code according to a driving situation of the steam generating device 10, an icon output in the water tank state output section 710 includes: a normal state icon 711 indicating a normal state when water is detected by the water level sensor 110 of the water tank 100; and a refill request icon 712 indicating a state, in which water is not detected by the water level sensor 110 of the water tank 100 and water charging is required, an icon output in the boiler state output section 730 includes: a standby state icon 732 indicating a standby state, in which water is not detected by the water level sensor 110 of the water tank 100, water is not detected by the high-water level sensor 311 of the boiler tank 300, and a pump 320 is not operated; a charging state icon 733 indicating that the pump 320 is continuously operated in a state where water is detected by the water level sensor 110 of the water tank 100 and water is detected by the high-water level sensor 311 of the boiler tank 300, so that the boiler tank 300 is in a charging state until water is detected by the high-water level sensor 311 of the boiler tank 300; a normal state icon 731 indicating a normal state, in which water is detected by the high-water level sensor 311 of the boiler tank 300 and an operation of the pump 320 is stopped; a recharging state icon 734 indicating a recharging state, in which the pump 320 is operated and the air purge 350 is not operated in a state where water is detected by the water level sensor 110 of the water tank 100, water is detected by the low-water level sensor 312 of the boiler tank 300, and water is not detected by the high-water level sensor 311; a water level error icon 735 indicating that the water level sensor 310 is in an error state when a low water level or a high water level is not detected in a situation where a low water level or a high water level needs to be detected; a pump error icon 736 indicating that an operation time of the pump 320 is exceeded when the pump 320 is continuously operated in a situation where the operation of the pump 320 needs to be stopped; and a thermistor error icon 737 indicating that the steam generating device has abnormality when a temperature value measured by the thermistor 330 deviates from a normal range, an icon output in the combustion state output section 740 includes: a normal state icon 741 indicating that the internal pressure of the boiler tank is in a normal state when it is measured that a pressure of the pressure switch 340 reaches a reference pressure value, so that the pressure switch 340 is operated (off state); a standby state icon 742 indicating that the burner 400 is in a standby state when water is not detected by the water sensor 310 of the boiler tank, or an error is detected in the water level sensor 310 or the thermistor 330 of the boiler tank; and a pressure switch error icon 744 indicating that the pressure switch 340 is in an error state when the reference pressure value is measured in a state where a temperature of the thermistor 330 is low, a message output from the message output section 750 includes: a situation notification message 751 formed of messages notifying a situation of the steam generating device 10 including an attention requiring situation, a wait requiring situation, and a steam preparation completion situation; and an error code message 752 outputting an error code according to a situation when an error situation is detected in the boiler tank 300 or the burner 400, entire accumulated hours, for which the steam generating device is booted and is used, are displayed on the standby screen 701, a temperature value measured by the thermistor 330 of the boiler tank 300 and an operation state of the air purge 350 are displayed on the message output section 750 in the form of an icon, when the pump 320 is being operated, but water is not detected by the water level sensor 310 during an operation of a steam boiler, the water level error icon 735 is output on the boiler state output section 730 and an error code according to the water level error icon 735 is output on the message output section 750, when only a high water level is detected by the water level sensor 310, but a low water level is not detected during an initial operation or driving of the steam boiler, the water level error icon 735 is output on the boiler state output section 730 and an error code according to the water level error icon 735 is output on the message output section 750, when the air purge 350 and the pump 320 are being operated, but the reference pressure value is measured by the pressure switch 340, the water level error icon 735 is output on the boiler state output section 730 and an error code according to the water level error icon 735 is output on the message output section 750, when the air purge 350 is being operated and the pump 320 is not operated, but the reference pressure value is measured by the pressure switch 340, the pressure switch error icon 744 is output on the combustion state output section 740 and an error code according to the pressure switch error icon 744 is output on the message output section 750, when water is not detected by the water level sensor 310 of the boiler tank 300 and the operation of the pump 320 exceeds a predetermined time in an initial charging state, in which a temperature value equal to or smaller than a reference value is measured by the thermistor 330, the pump error icon 736 is output on the boiler state output section 730 and an error code according to the pump error icon 736 is output on the message output section 750, when a low water level is detected by the water level sensor 310 of the boiler tank 300 and the operation of the pump 320 exceeds the predetermined time in a recharging state, in which a temperature value equal to or larger than the reference value is measured by the thermistor 330, the pump error icon 736 is output on the boiler state output section 730 and an error code according to the pump error icon 736 is output on the message output section 750, when a temperature below zero is detected by the thermistor 330, the thermistor error icon 737 is output on the boiler state output section 730 and an error code according to the thermistor error icon 737 is output on the message output section 750, when a temperature equal to or higher than 300° C. is detected by the thermistor 330, the normal state icons 711, 721, 731, and 741 and error codes according to the normal state icons 711, 721, 731, and 741 are output on the message output section 750, when a temperature in a range of 200° C. to 250° C. is detected by the thermistor 330, the thermistor error icon 737 is output on the boiler state output section 730 and an error code according to the thermistor error icon 737 is output on the message output section 750, the attention requiring situation of the situation notification message 751 includes a situation where the water tank 100 is being charged or the fuel tank 200 is being charged, the standby requiring situation of the situation notification message 751 includes a situation where both the water tank 100 and the fuel tank 200 are in the normal state and the boiler tank 300 is being charged or the burner 400 is being operated, and the steam preparation completion situation of the situation notification message 751 includes a situation where all of the water tank 100, the fuel tank 200, the boiler tank 300, and the burner 400 are in the normal state.

The burner 400 is a combustion type, and is provided with an air blowing fan 410, which discharges exhaust gas generated during combustion and a flame detecting sensor 440, which detects flame during combustion, the icon output in the combustion state output section 740 further includes: an on-combustion icon 743 indicating on-combustion when the burner 400 combusts fuel and heats the boiler tank 300; and a flame detection error icon 745 indicating that the flame detecting sensor 440 is in an error state when flame is not detected by the flame detecting sensor 440 of the burner 400 during the combustion or flame is detected during non-combustion, when the air blowing fan 410 of the burner 400 is being operated and a low water level or a high water level is detected by the water level sensor 310 of the boiler tank 300, but flame is not detected by the flame detecting sensor 440 of the burner 400, the flame detection error icon 745 is output on the combustion state output section 740 and an error code according to the flame detection error icon 745 is output on the message output section 750, and when water is not detected by the water level sensor 310 of the boiler tank 300, but flame is detected by the flame detecting sensor 440 of the burner 400, the flame detection error icon 745 is output on the combustion state output section 740 and an error code according to the flame detection error icon 745 is output on the message output section 750.

When the temperature measured by the thermistor 330 is equal to or lower than 80° C. at an initial driving, or the steam generating device is being cooled after the driving for a predetermined time, not at the initial driving, or the boiler tank 300 is in a charging state, a valve is opened by the air purge 350, and when the temperature measured by the thermistor 330 is equal to or higher than 80° C. in the state where the pressure measured by the pressure switch 340 increases, the valve is blocked by the air purge 350.

The present invention has the effect below.

That is, it is possible to monitor an operation situation of a steam generating device through a simple screen configuration in real time at a glance, and enable a user to diversely analyze reasons caused by various factors when an abnormal operation is generated and cope with the abnormal operation.

DETAILED DESCRIPTION

Hereinafter, an exemplary embodiment of the present invention will be described based on the accompanying drawings. However, the scope of the present invention shall be recognized by the description of the claims. Further, a description of a publicly known technology, which makes an essential point of the present invention be obscure, is omitted.

Figure 1:
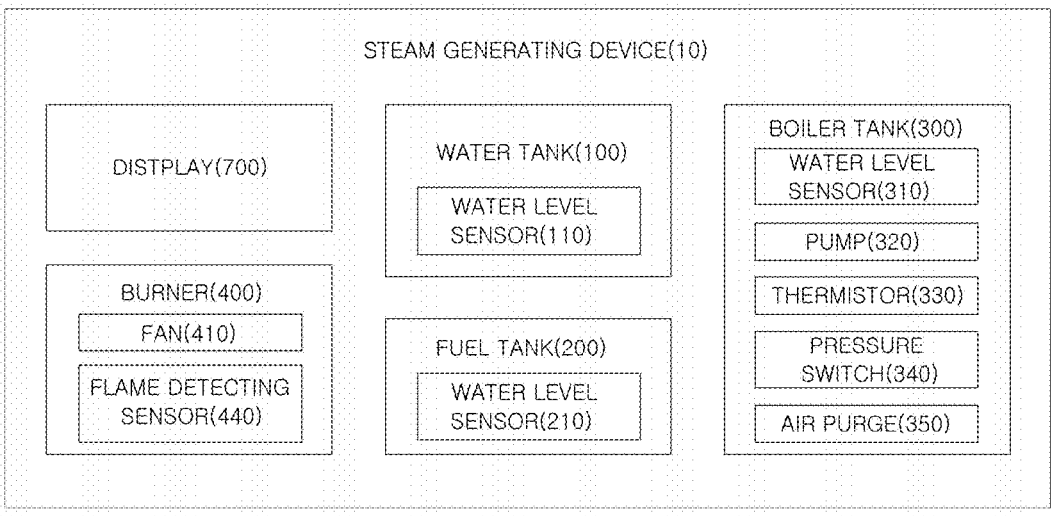
FIG. 1 is a block diagram illustrating an entire configuration of a steam generating device.

The present invention relates to a monitoring system for a steam generating device mounted with a display, and relates to a system, in which a steam generating device (ex. steam boiler) 10 including a water tank 100, a fuel tank 200, a boiler tank 300, and a burner 400 is mounted with a display 700 to monitor a driving situation or an erroneous situation of the steam generating device 10 through the display 700 as illustrated in FIG. 1.

A water level sensor 110, which measures a water level of stored water is installed in the water tank 100, in which water to be supplied to the boiler tank 300 is stored, and a water level sensor 210, which measures a water level of stored fuel, is installed in the fuel tank 200, in which fuel to be supplied to the burner 400 is stored.

The boiler tank 300 is supplied with water from the water tank 100 and is supplied with heat by the burner 400 to generate steam, and is provided with a water level sensor 310, which measures a water level of received water, a pump 320, which supplies water from the water tank 100, a thermistor 330, which measures an internal temperature, a pressure switch 340, which measures an internal pressure, and an air purge 350, which discharges condensed air inside the boiler when the temperature measured by the thermistor 330 is equal to or lower than a reference temperature.

In the meantime, the water level sensor 110 for the water tank 100 and the water level sensor 210 for the fuel tank 200 among the respective water level sensors mentioned in the present invention aim to detect the water levels inside the tank and smoothly supply water and fuel, and prevent damage due to idle running of the water pump 320 and the fuel pump due to the stop of the operation when the water level is not detected.

The water level sensor 310 of the boiler tank 300 includes commonly used three water level sensors (a high-water level sensor, a low/high-water level detection signal common connection sensor, and a low-water level sensor) detecting high/low-water levels, respectively, and "a water level is not detected" means the state where water is not detected by any one of the high-water level sensor, the low/high-water level detection signal common connection sensor, and the low-water level sensor). Further, "a water level is detected" means any one of the state where the low-water level sensor and the common connection sensor simultaneously detect water, the state where the high-water level sensor and the common connection sensor simultaneously detect water, and the state where the low-water level sensor, the common connection sensor, and the high-water level sensor simultaneously detect water.

In this case, the air purge 350 serves to remove condensed air inside the boiler in an initial state where a temperature of water inside the boiler increases and a pressure of the boiler simultaneously increases. When the condensed air is not removed in the initial state, a pressure sharply increases even though water is not completely heated, so that a pressure of a reference pressure (8.5 bars) or more operates the pressure switch 340 to stop the driving of the boiler. Accordingly, in order to prevent the abnormal pressure from sharply increasing due to the inside condensed air according to an increase in a temperature of water of the boiler, a valve (a solenoid valve, and the like) is opened at a temperature of a regulated predetermined temperature (for example, about 80° C.) or lower so as to remove the condensed air in a vacuum state inside the boiler to prevent an internal pressure of the boiler tank 300 from sharply increasing, and the valve is blocked at the regulated predetermined temperature or higher in order to prevent steam inside the boiler from leaking to the valve when the pressure of the boiler increases by a normal increase in pressure.

In the meantime, when an air purge valve is opened in a situation where the steam generating device is cooled after the driving for a predetermined time, not the initial driving, even the steam remaining in the boiler tank 300 is discharged to damage the water tank, so that it is preferable to drive the air purge 350 and open the air purge valve when the internal temperature of the boiler is decreased and the steam (gas) becomes a water (liquid) state.

The burner 400 combusts fuel received from the fuel tank 200 and generates heat, and is provided with an air blowing fan 410, which discharges exhaust gas generated during the combustion, and a flame detecting sensor 440, which detects flame during the combustion, and the burner 400 corresponds to only to a combustion-type steam generating device. The air blowing fan 410 also serves to discharge exhaust gas and isolate the outside and the inside of the boiler. In the meantime, in the case of an electric steam generating device, the burner 400 is replaced with a heater, which receives electricity and generates heat, and the fuel tank 200 is not required.

The display 700 is a part, on which a screen for monitoring the driving situations of the water tank 100, the fuel tank 200, the boiler tank 300, and the burner 400 is output, and is formed at one side of an upper end of a product formed with the steam generating device 10.

Figure 7:
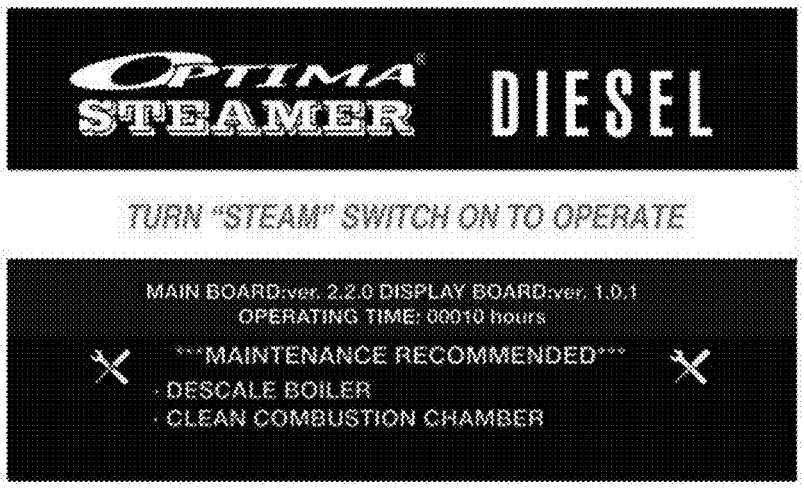
FIG. 7 is a diagram of an example of a wait screen.

The screen output on the display 700 is formed of a wait screen 701 output in a standby state, in which power is applied to the steam generating device 10 and the system is not booted as illustrated in FIG. 7, and a driving screen 702 output in a driving state, in which power is applied to the steam generating device 10 and the system is booted illustrated in FIG. 9 and below.

In the wait screen 701, total operating hours of a product, that is, entire accumulated hours, for which the steam generating device is booted and is used, may be displayed, and corresponds to "OPERATING TIME: 0010 hours" illustrated in FIG. 7, which means that accumulated hours of use of the steam generating device are 10 hours. There is a case where a specific person uses the steam generating device at home, but when unspecified individuals use the steam generating device at a company, it is not easy to estimate hours of use, so that the display of the accumulated hours of use aims to directly notify a user of the accumulated hours of use on the standby screen and simultaneously notify the user of a use life span of a product and the arrival of a replacement time of a consumable.

Figure 8:
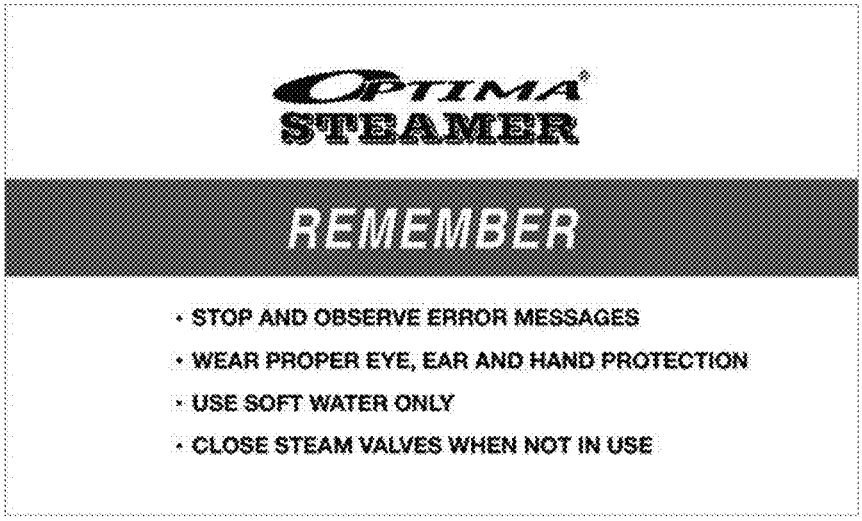
FIG. 8 is a diagram of an example of a booting screen.

In the meantime, a booting screen 701*a* illustrated in FIG. 8 may be additionally formed, and is a screen, which includes a warning message and is output before the driving screen 702 is output during a process of booting the system when the burner is driven in the standby state.

Figure 9:
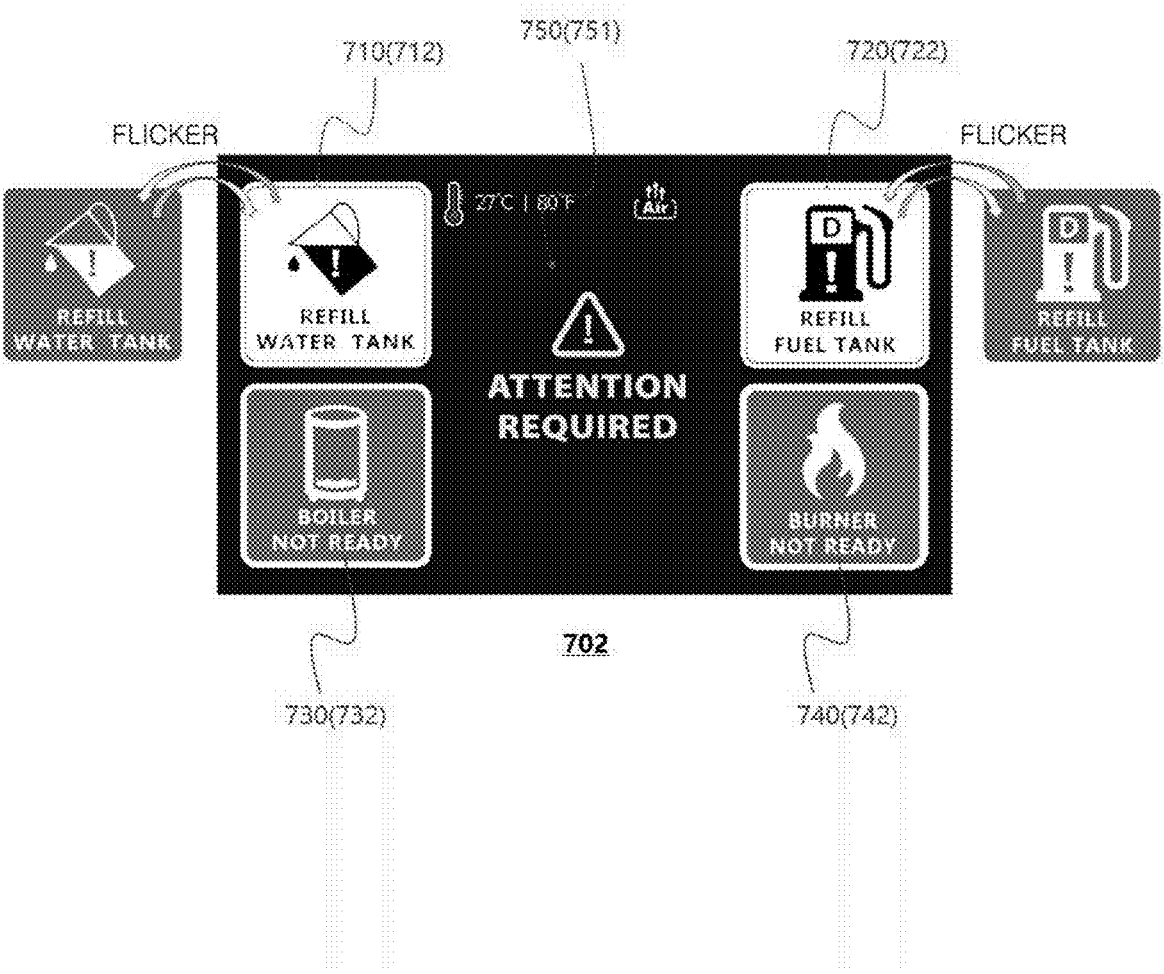
FIGS. 9 to 18 are diagrams illustrating examples of a driving screen in a normal operation situation.

The driving screen 702 is formed of a water tank state output section 710, a fuel tank state output section 720, a boiler state output section 730, a combustion state output section 740, and a message output section 750 as illustrate din FIG. 2, and an embodiment thereof is illustrated in FIG. 9 and below.

Figure 3:
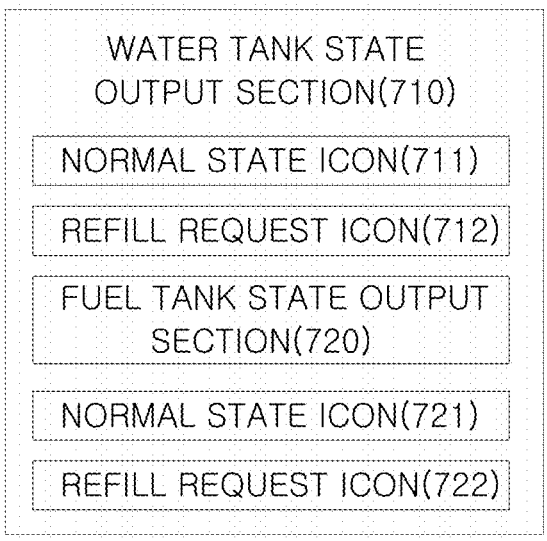
FIGS. 3 to 6 are block diagrams illustrating detailed configurations of the driving screen.

The water tank state output section 710 is a section outputting a water charging state of the water tank according to the water level sensor 110 of the water tank, and a normal state icon 711 or a refill request icon 712 may be output as illustrated in FIG. 3.

Figure 11:
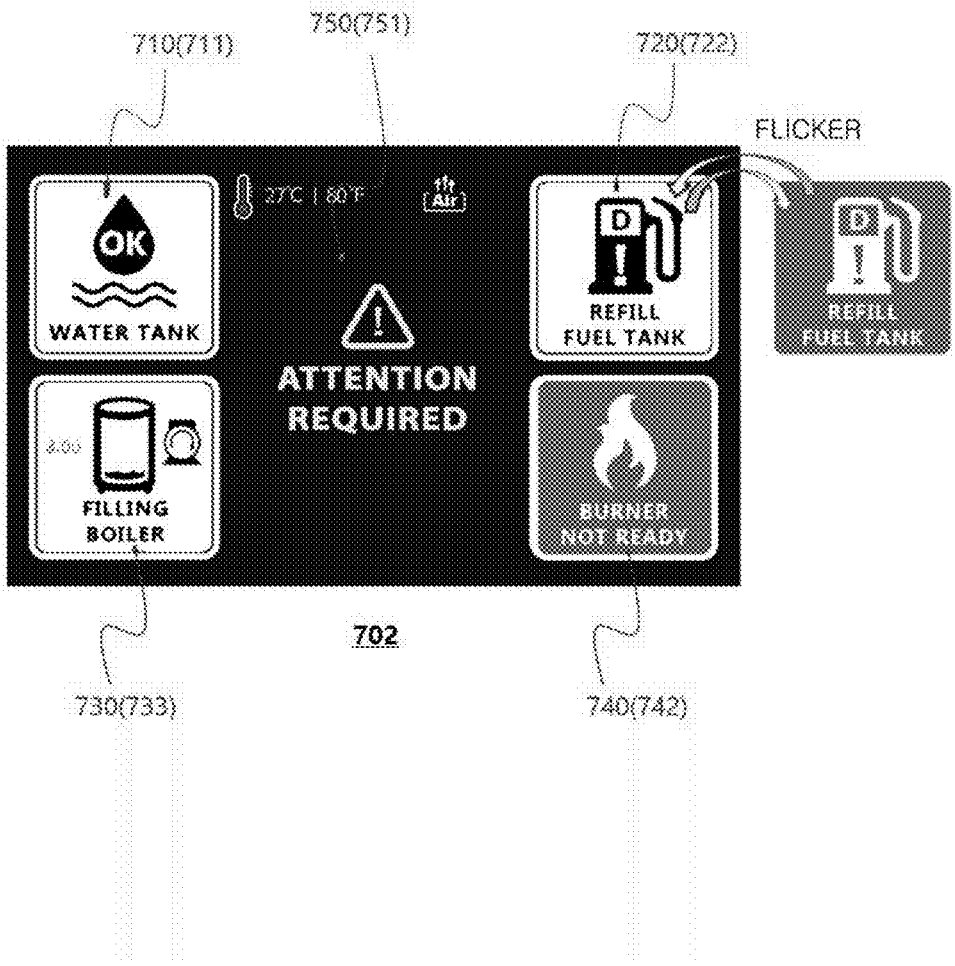
Figure 12:
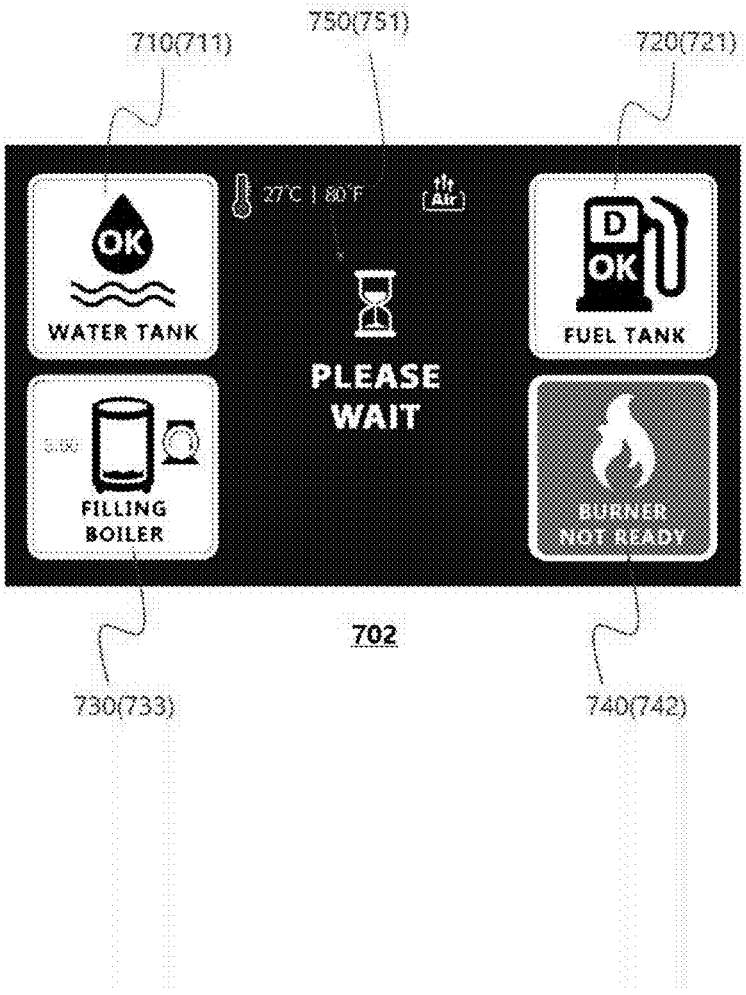

The normal state icon 711 is an icon indicating a normal state, in which a water level is detected by the water level sensor 110 of the water tank 100, as illustrated in FIG. 11, and the refill request icon 712 is an icon indicating a state, in which a water level is not detected by the water level sensor 110 of the water tank 100, so that charging of water is required, as illustrated in FIG. 9.

The fuel tank state output section 720 is a section outputting a fuel charging state of the fuel tank according to the water level sensor 210 of the fuel tank, and a normal state icon 721 or a refill request icon 722 may be output as illustrated in FIG. 3.

Figure 10:
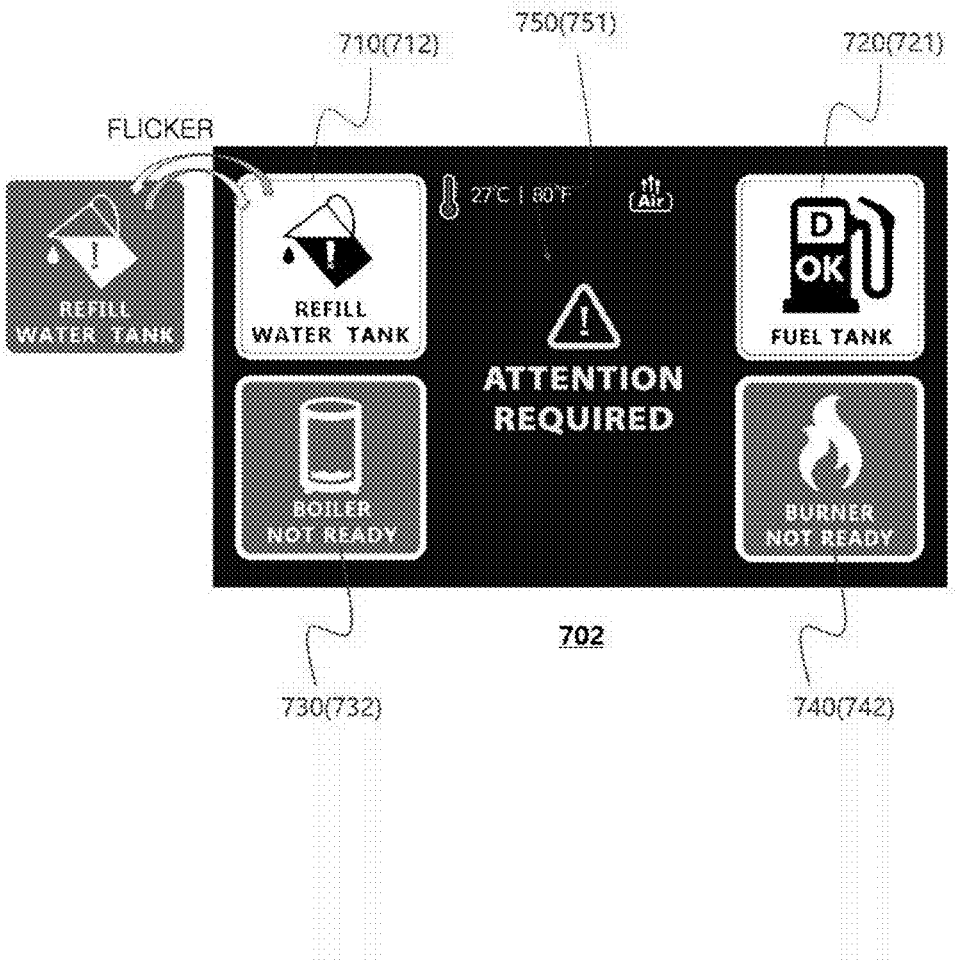

The normal state icon 721 is an icon indicating a normal state, in which a water level is detected by the water level sensor 210 of the fuel tank 200, as illustrated in FIG. 10, and the refill request icon 722 is an icon indicating a state, in which a water level is not detected by the water level sensor 210 of the fuel tank 200, so that charging of fuel is required, as illustrated in FIG. 9.

The refill request icons 712 and 722 of the water tank state output section 710 and the fuel tank state output section 720 may be formed to flicker in order to clearly notify the user of the necessity of the charging of water or fuel.

Figure 4:
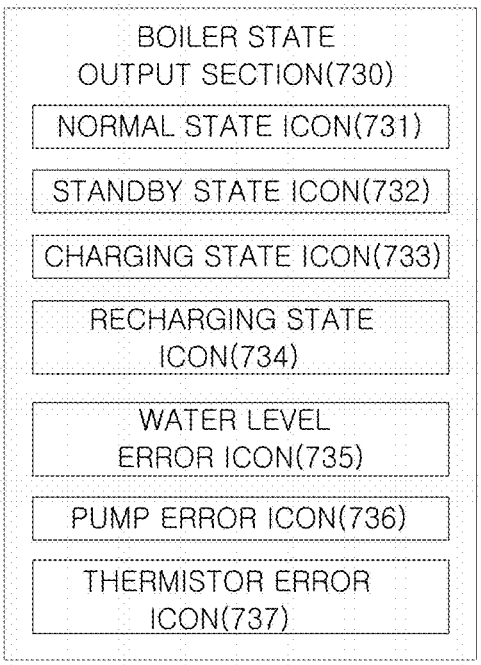

The boiler state output section 730 is a section, which outputs a water charging state of the boiler tank according to the water level sensor 310 of the boiler tank, and outputs an error state when an abnormal state is detected by the water level sensor 310 or the thermistor 330 of the boiler tank, and is formed of a normal state icon 731, a standby state icon 732, a charging state icon 733, a recharging state icon 734, a water level error icon 735, a pump error icon 736, and a thermistor error icon 737 as illustrated in FIG. 4.

The standby state icon 732 is an icon indicating a standby state, in which a water level is not detected by the water level sensor 110 of the water tank 100, a water level is not detected by the low-water level sensor of the boiler tank 300, and the pump 320 is not operated, as illustrated in FIG. 9.

The charging state icon 733 is an icon indicating that a water level is detected by the water level sensor 110 of the water tank 100, a water level is not detected by the low-water level sensor of the boiler tank 300 or a low water level is detected, and the pump 320 is continuously operated, so that the boiler tank 300 is in a charging state until a high water level is detected by the water level sensor 310 of the boiler tank 300, as illustrated in FIG. 11. In this case, the air purge 350 is operated at the same time to open the valve.

Figure 14:
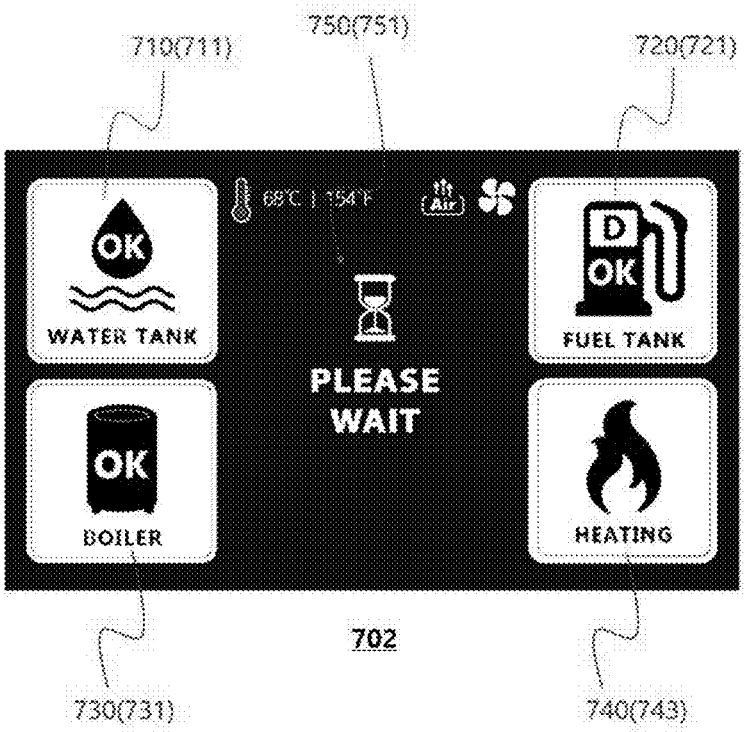
Figure 15:
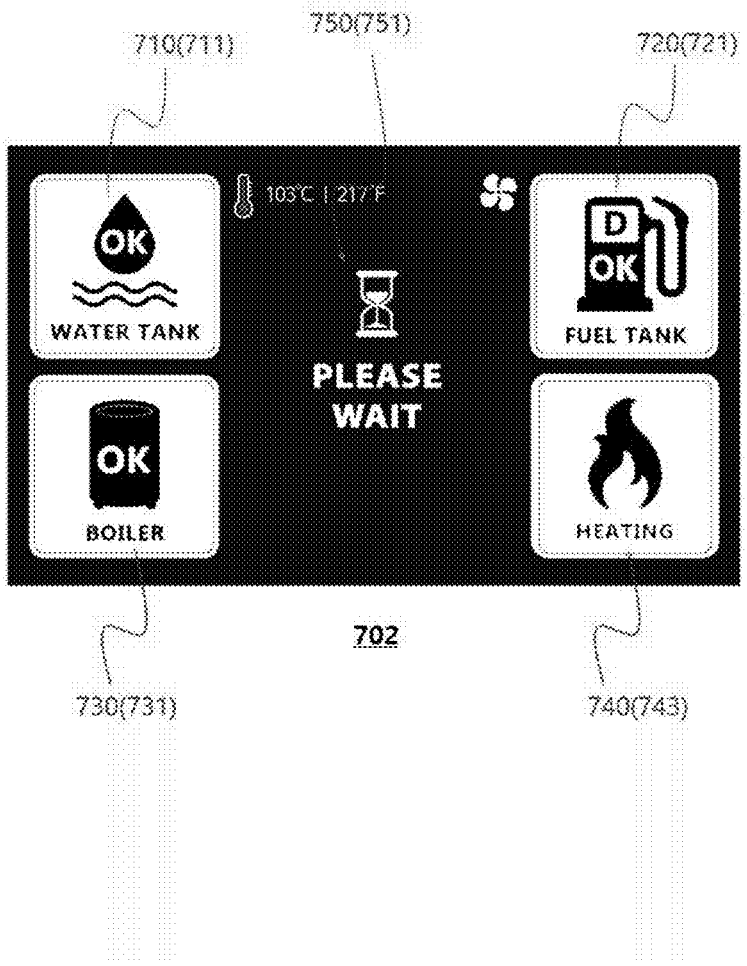

The normal state icon 731 is an icon indicating a normal state, in which a high water level is detected by the water level sensor 310 of the boiler tank 300 and the operation of the pump 320 is stopped, as illustrated in FIG. 14.

Figure 18:
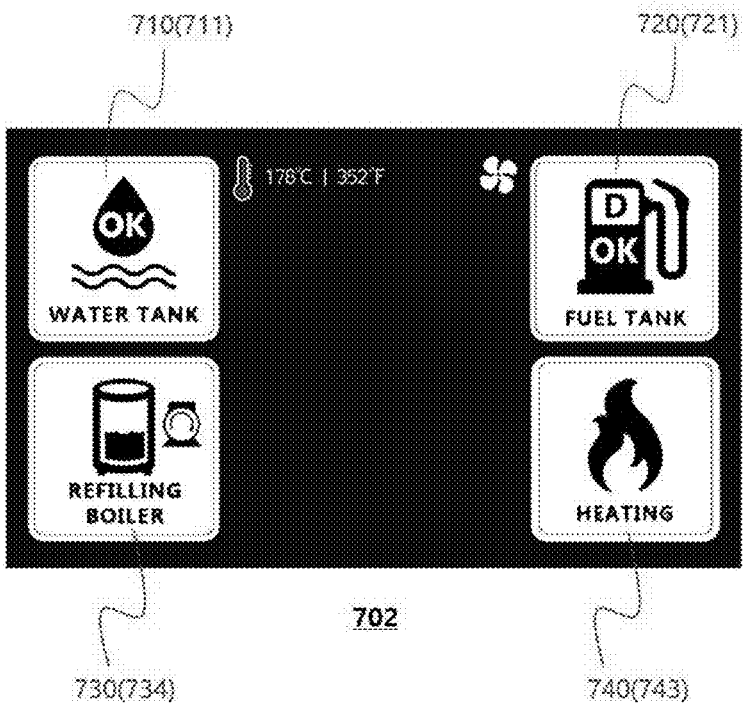

The recharging state icon 734 is an icon indicating a recharging state, in which the pump 320 is operated in the state where a water level is detected by the water level sensor 110 of the water tank 100, a low water level is detected by the water level sensor 310 of the boiler tank 300, and a high water level is not detected, and the air purge 350 is not operated, as illustrated FIG. 18.

Figure 19:
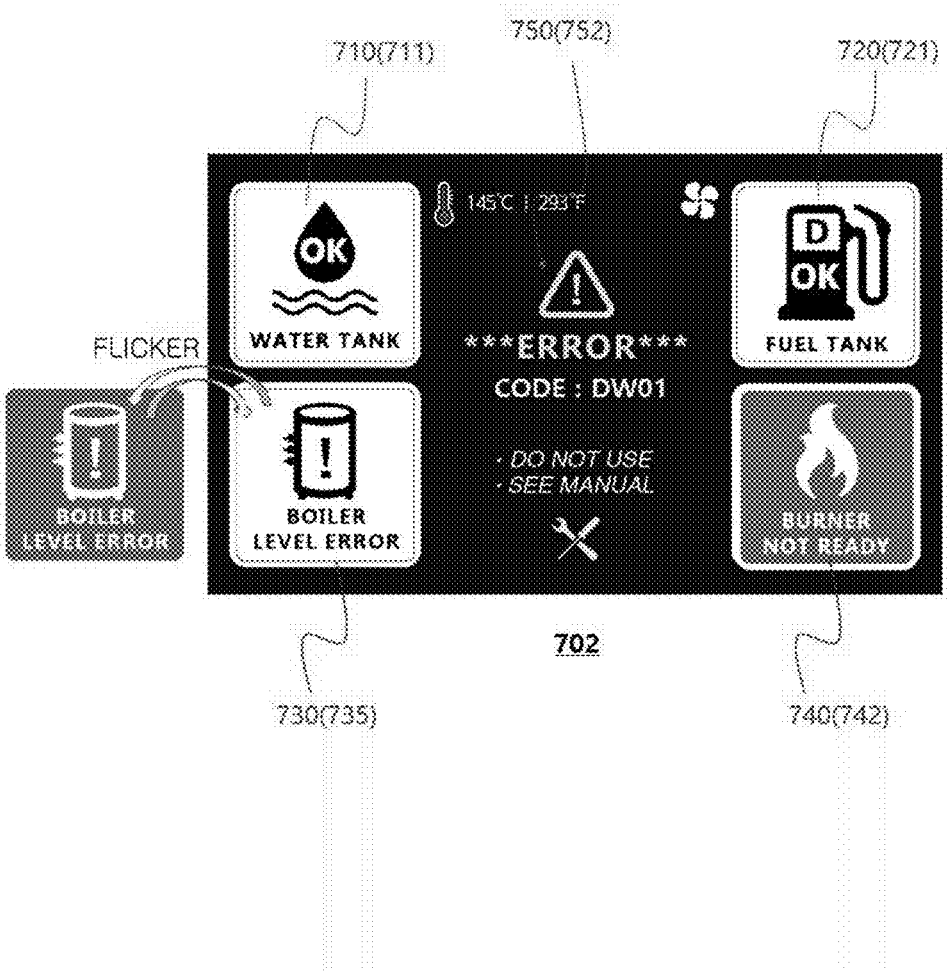
FIGS. 19 to 29 are diagrams illustrating examples of a driving screen in an erroneous operation situation.
Figure 20:
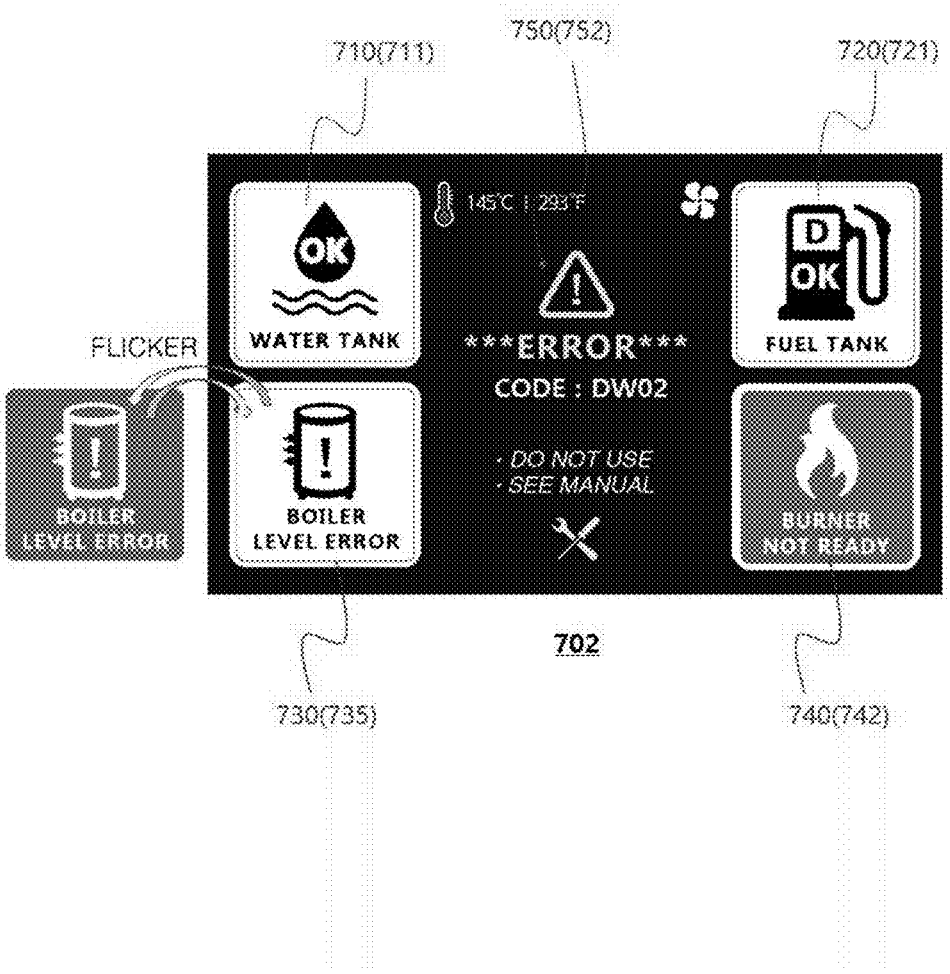
Figure 21:
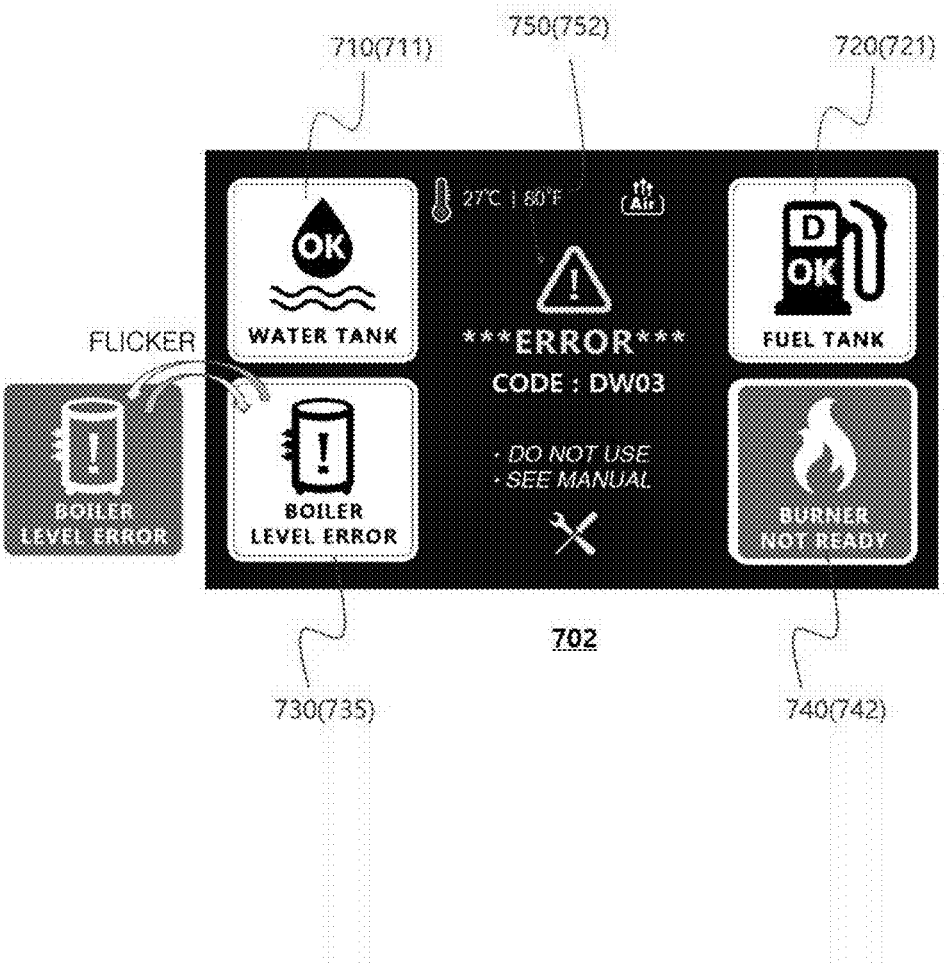

The water level error icon 735 is an icon indicating that the water level sensor 310 is in an error state when a low water level or a high water level is not detected in a situation where a low water level or a high water level needs to be detected, as illustrated in FIG. 19. That is, when a low water level or a high water level is not detected by the water level sensor 310 of the boiler tank 300 despite the normal state or the recharging state, the water level error icon 735 flickers to notify the user that the water level sensor 310 of the boiler tank 300 is being erroneously operated.

Figure 25:
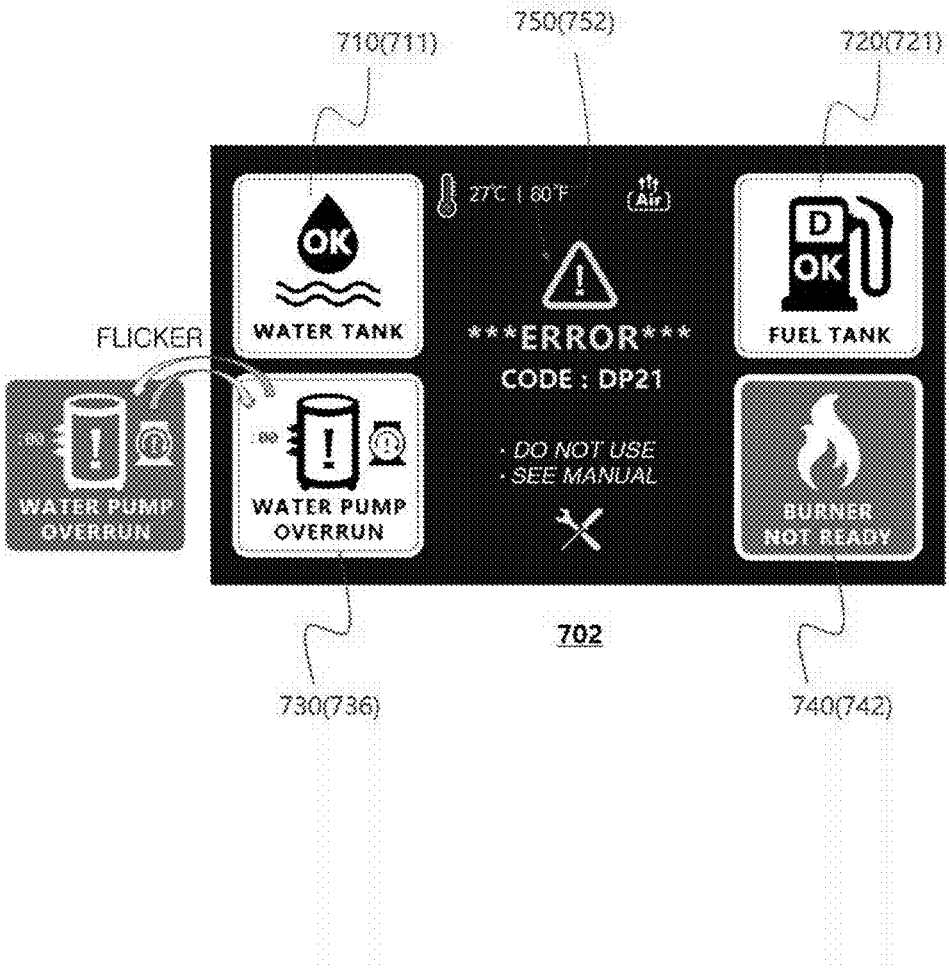
Figure 26:
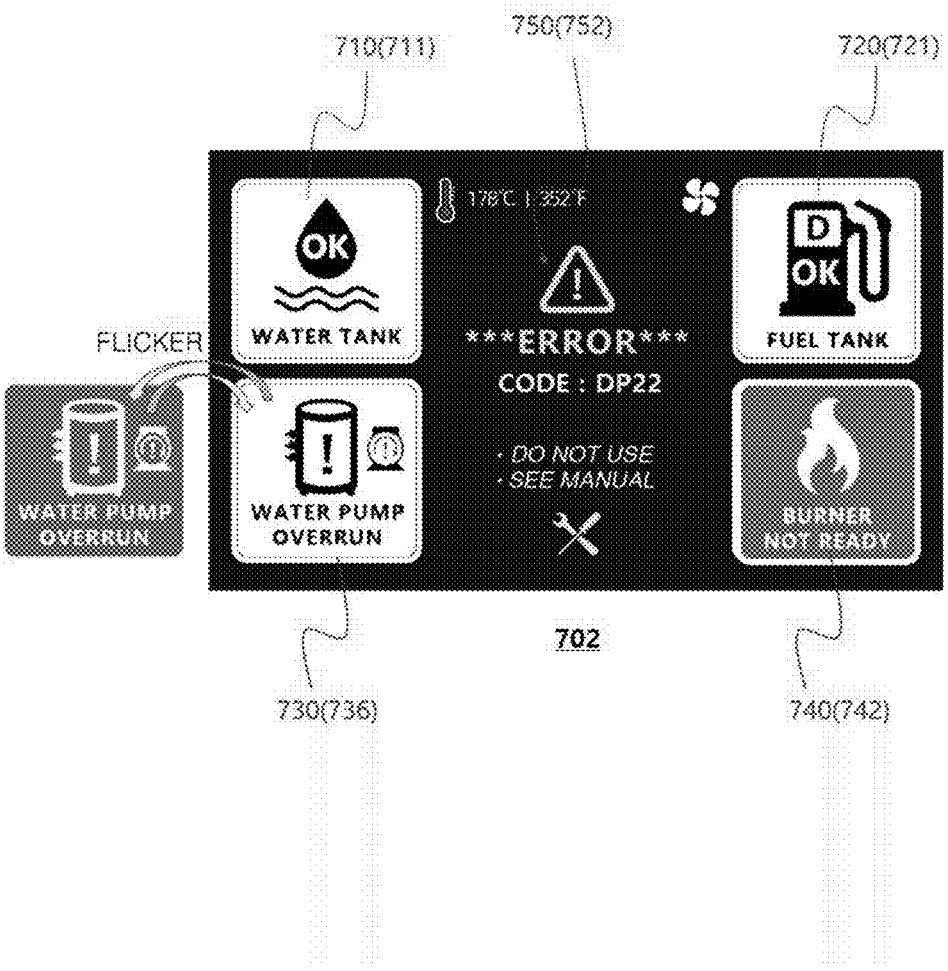
Figure 27:
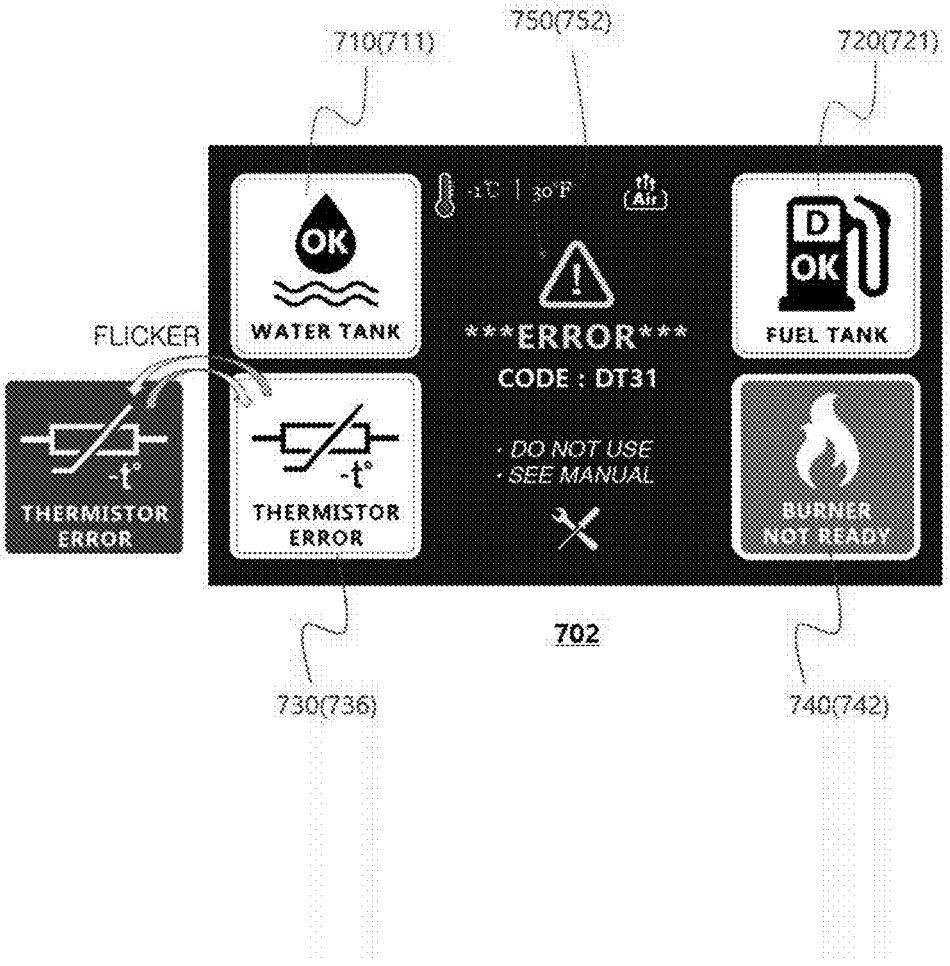
Figure 28:
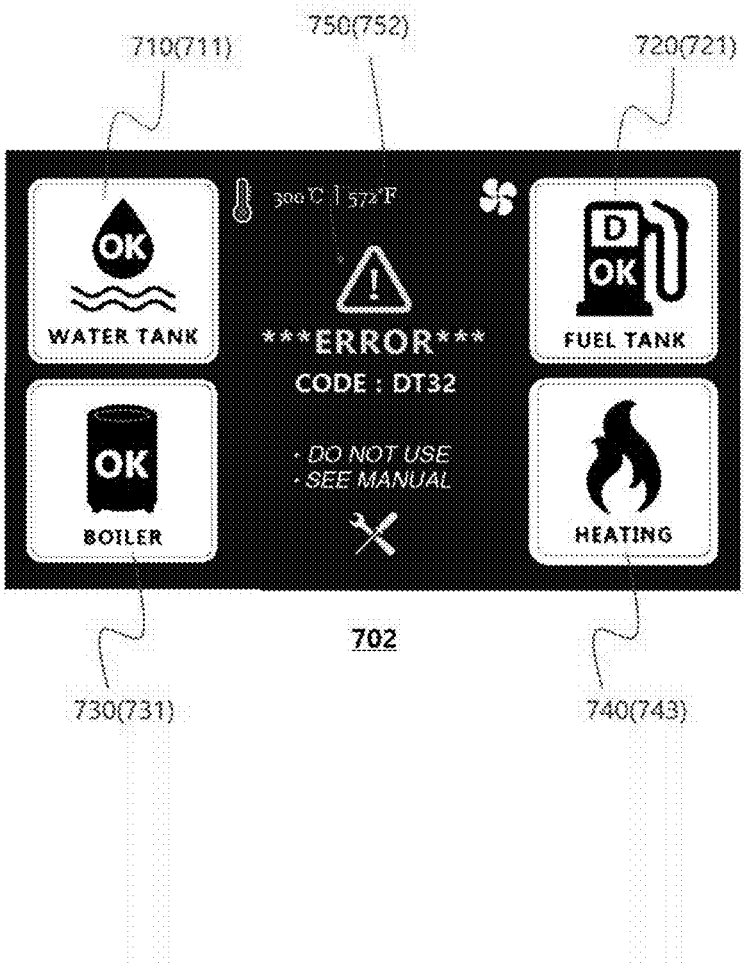
Figure 29:
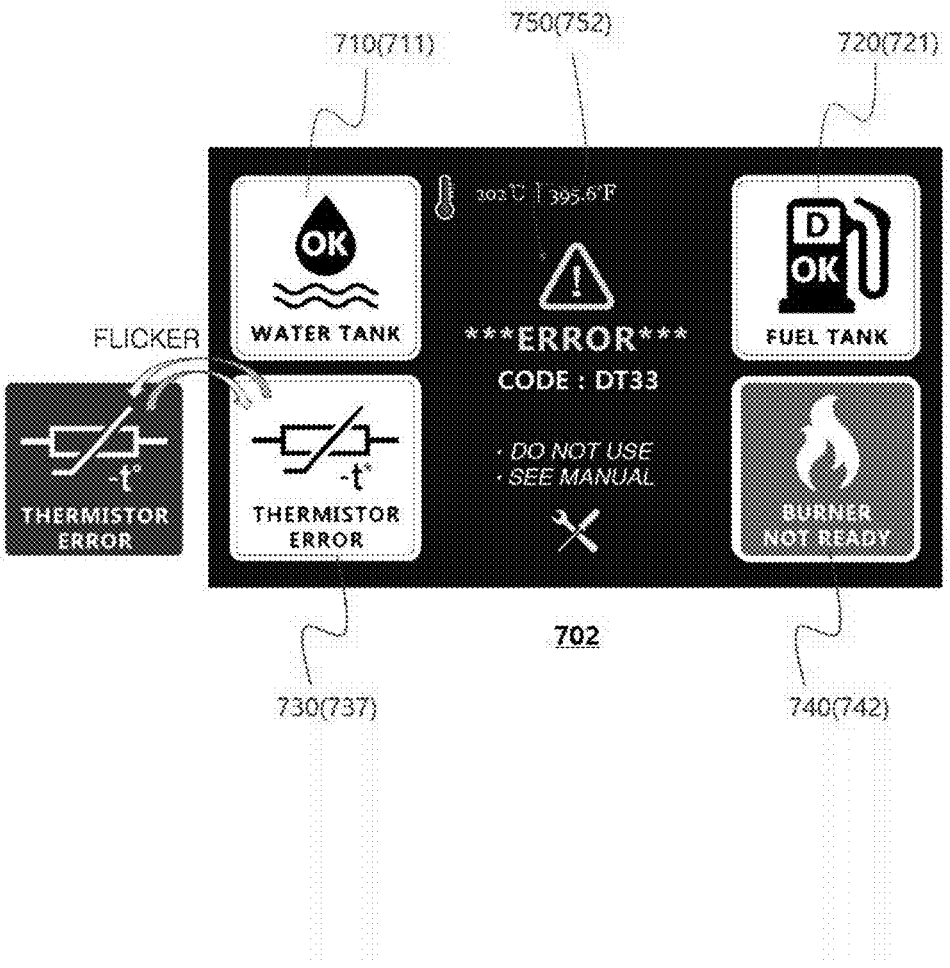

The pump error icon 736 is an icon indicating that the pump 320 is in an error state when the pump 320 is continuously operated in a situation where the operation of the pump 320 needs to be stopped as illustrated in FIG. 25, and when an operation time of the pump 320 exceeds a predetermined time (for example, three minutes) but a high water level is not detected in the charging state, or an operation time of the pump 320 exceeds a predetermined time (for example, one minute) but a high water level is not detected in the recharging state, the pump error icon 736 flickers to notify the user that the operation time of the pump 320 is exceeded.

The thermistor error icon 737 is an icon indicating that the thermistor 330 is in an error state, in which a temperature value measured by the thermistor 330 deviates from a normal range, and when a resistance value of the thermistor 330 is infinite, so that a temperature below zero is detected, or when the thermistor 330 is burned and sticks due to a short phenomenon and becomes a state where there is no resistance value, and a temperature of 300° C. or higher is detected, the thermistor error icon 737 flickers to notify the user that the machine has abnormality.

Figure 5:
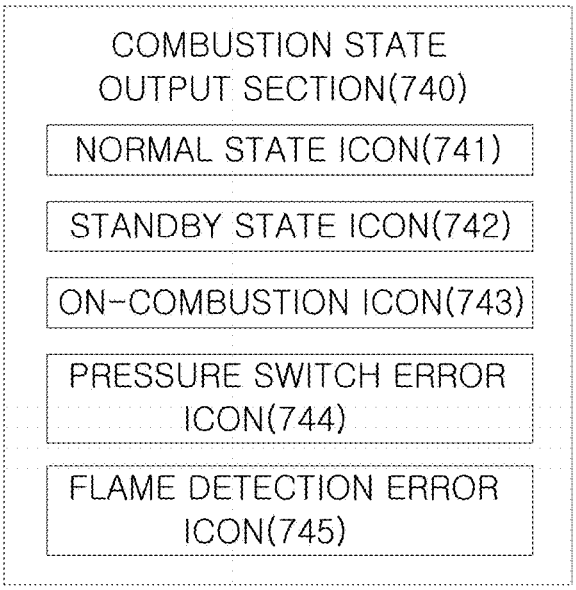
Figure 31:
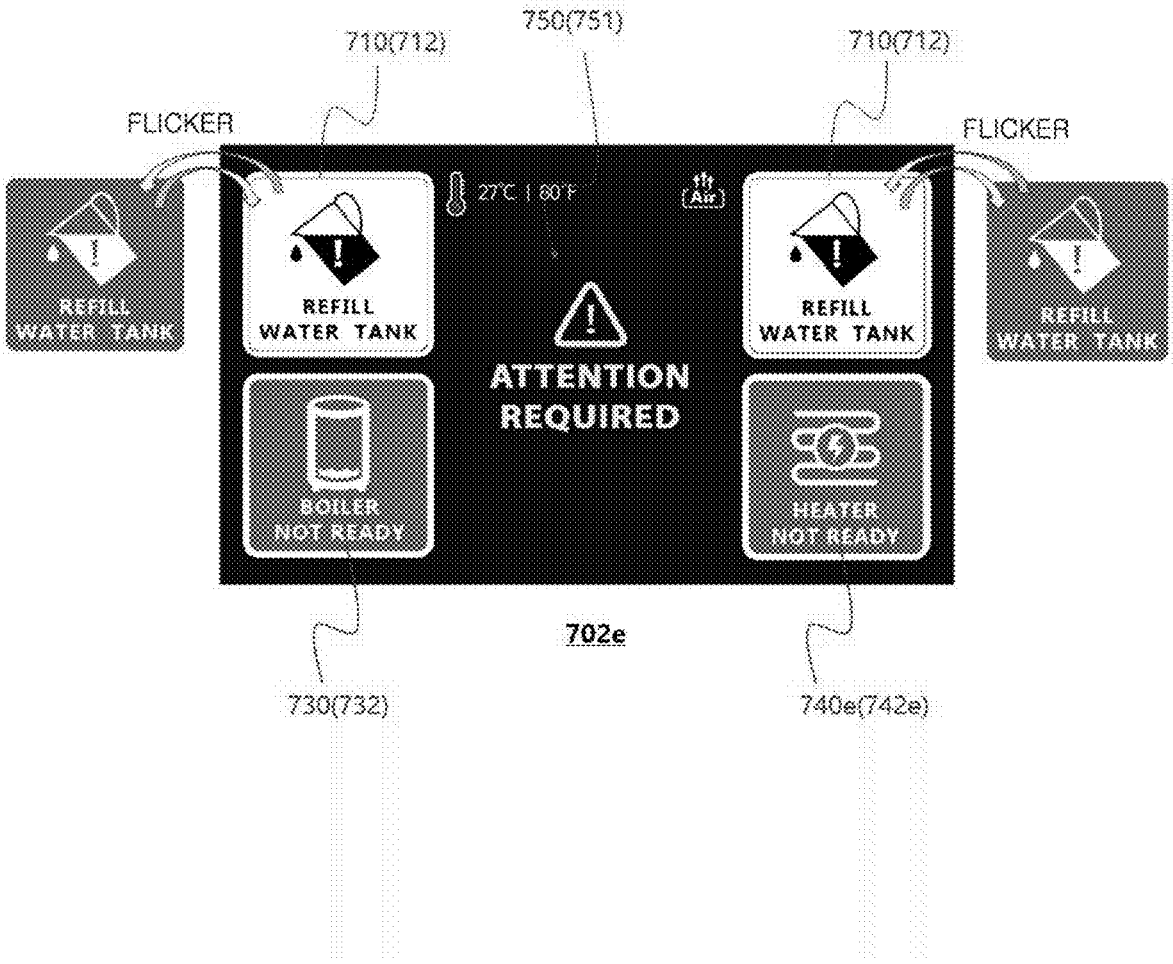
FIGS. 31 and 32 are diagrams illustrating examples of a driving screen of an electric steam generating device.
Figure 32:
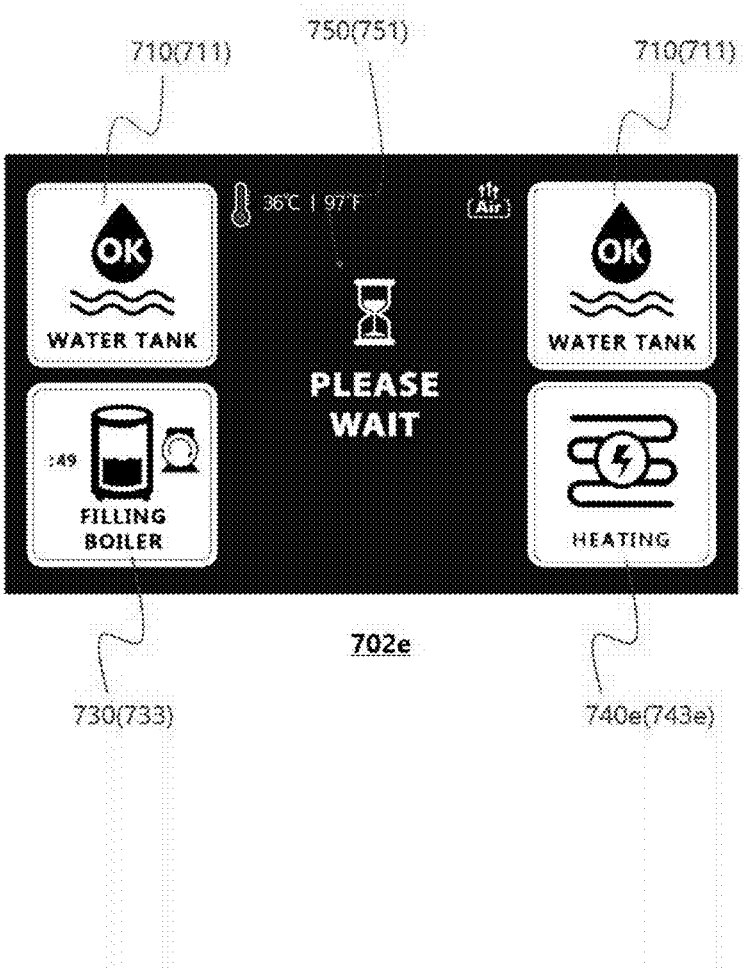

The combustion state output section 740 is a section, which outputs a combustion state of the burner 400 and outputs an error state when the pressure switch 340 of the boiler tank or the flame detecting sensor 440 of the burner detects an abnormal state, and is formed of a normal state icon 741, a standby state icon 742, an on-combustion icon 743, a pressure switch error icon 744, and a flame detection error icon 745, as illustrated in FIG. 5. In the meantime, in the case of the electric steam generating device, the icons may be changed as illustrated in FIGS. 31 and 32.

Figure 16:
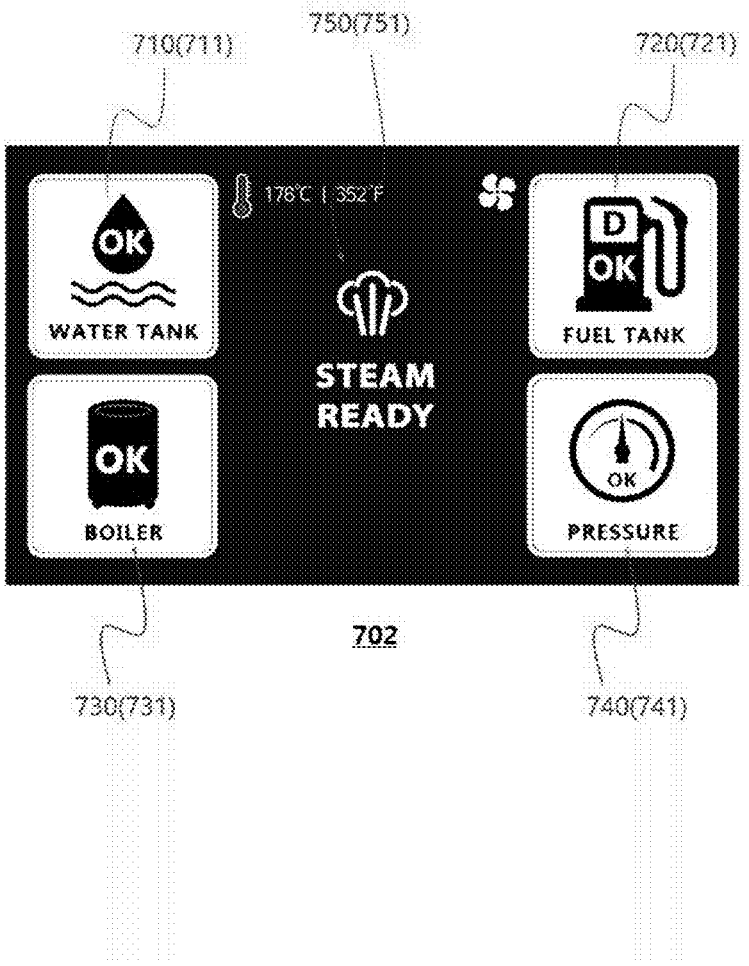
Figure 17:
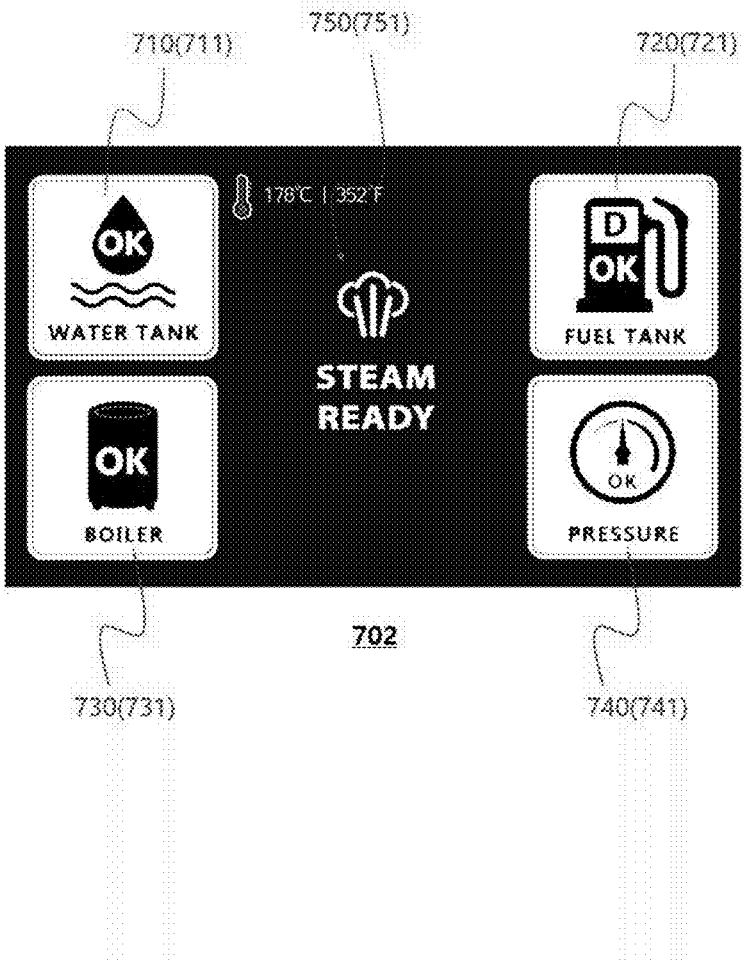

The normal state icon 741 is an icon indicating that the internal pressure of the boiler tank is in a normal state when the internal pressure of the boiler tank reaches a reference pressure value of the pressure switch 340 and the boiler tank is operated as illustrated in FIG. 16.

The standby state icon 742 is an icon indicating that the burner 400 is in a standby state when water is not detected by the water level sensor 310 of the boiler tank, or an error is detected in the water level sensor 310, the pump 320, or the thermistor 330 of the boiler tank as illustrated in FIG. 9.

Figure 13:
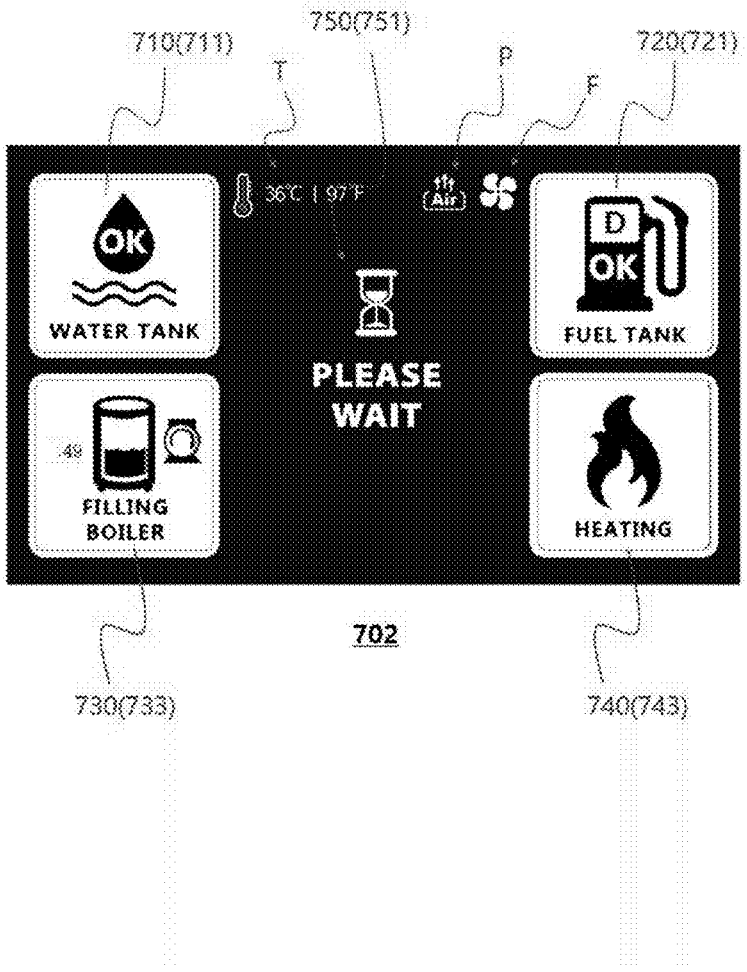

The on-combustion icon 743 is an icon indicating that the fuel is in the on-combustion state when the burner 400 combusts fuel to heat the boiler tank 300 as illustrated in FIG. 13, and when a low water level or a low/high water level is detected by the water level sensor 310 of the boiler tank 300, the air blowing fan 410 of the burner 400 is driven, and the pressure value of the pressure switch 340 of the boiler tank 300 is equal to or smaller than a reference value (8.5 bars), this is recognized as on-combustion, so that the on-combustion icon 743 is output.

Figure 22:
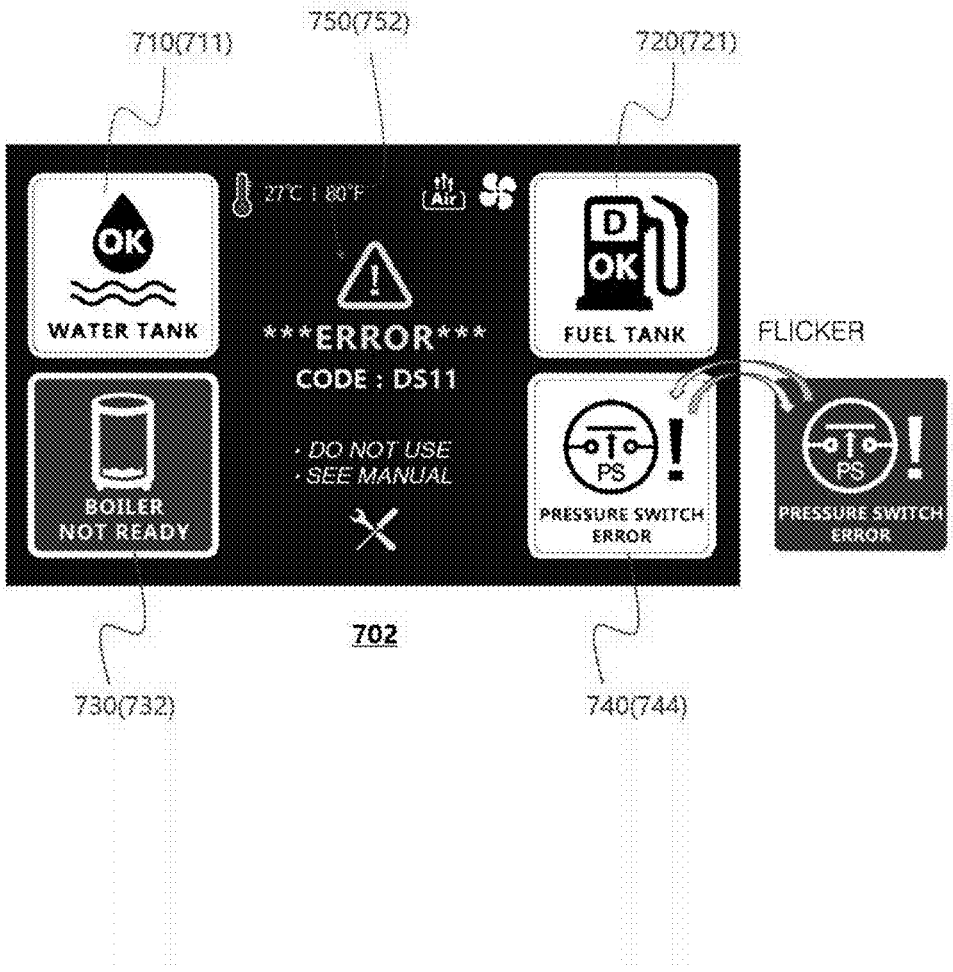

The pressure switch error icon 744 is an icon indicating that the pressure switch 340 is in an error state when the pressure value reaches the reference pressure value in the state where a temperature of the thermistor 330 is low as illustrated in FIG. 22. The error state corresponds to the case where when the air purge 350 is operated in the state where the pump 320 is not operated, the pressure value of the pressure switch 340 of the boiler tank 300 reaches the reference pressure value (8.5 bars) and the pressure switch 340 of the boiler tank 300 is measured to be operated (off state), and the like.

Figure 23:
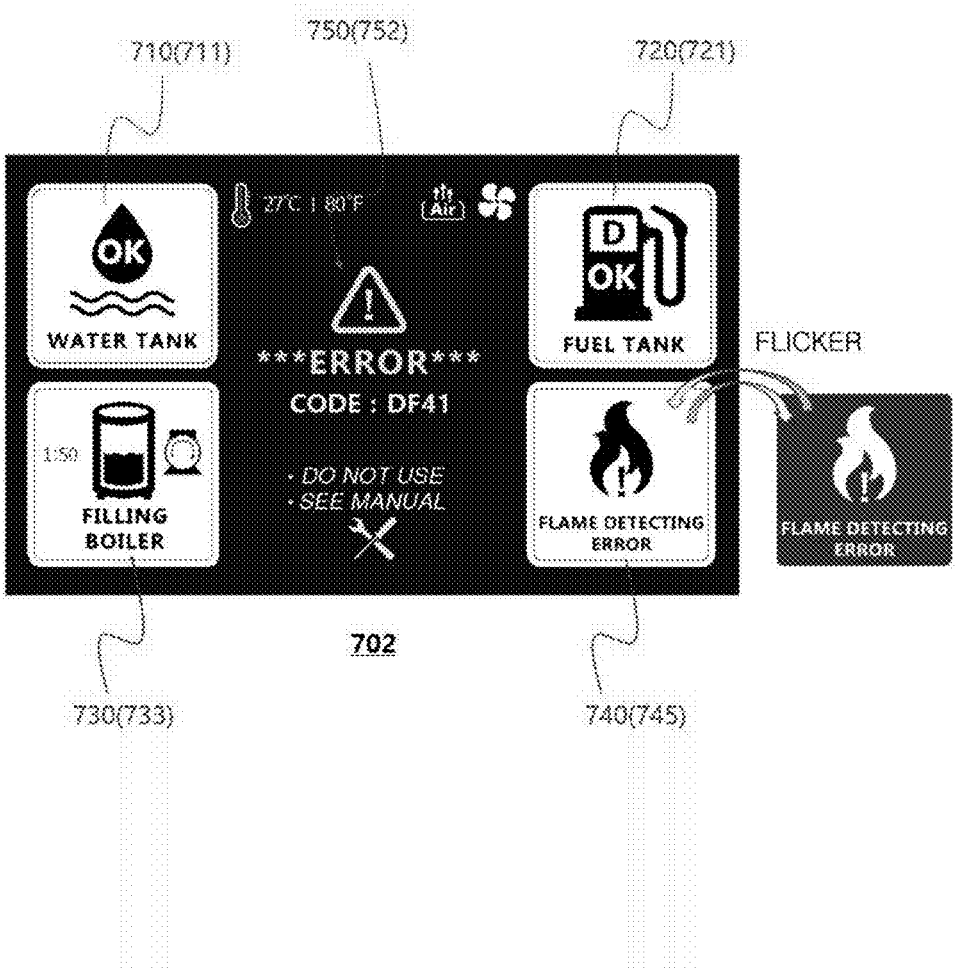
Figure 24:
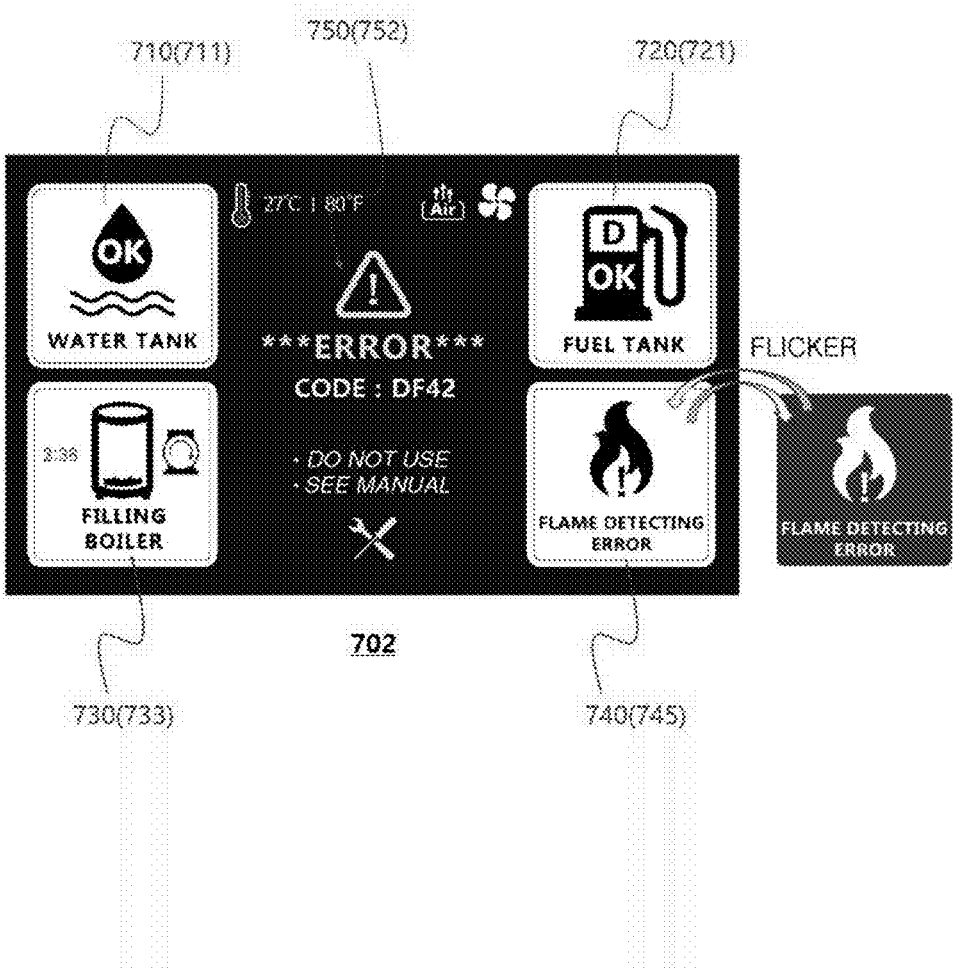

The flame detection error icon 745 is an icon indicating that the flame detecting sensor 440 is in an error state when flame is not detected by the flame detecting sensor 440 of the burner 400 during the combustion or when the flame is detected by the flame detecting sensor 440 of the burner 400 during the non-combustion as illustrated in FIG. 23, and the error state corresponds to the case where water is not detected by the water level sensor 310 of the boiler tank 300, but the on-combustion is detected (flame is detected), and the like.

Figure 6:
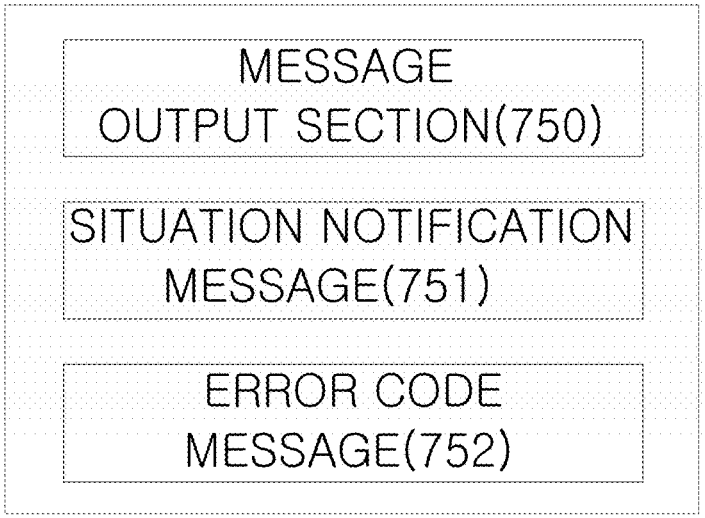

The message output section 750 is a section outputting a message or an error code according to a driving situation of the steam generating device 10, and a situation notification message 751 or an error code message 752 may be output as illustrated in FIG. 6.

The situation notification message 751 is formed of a message notifying a situation, such as an attention requiring situation, a wait requiring situation, and a steam preparation completion situation, of the steam generating device 10.

Figure 2:
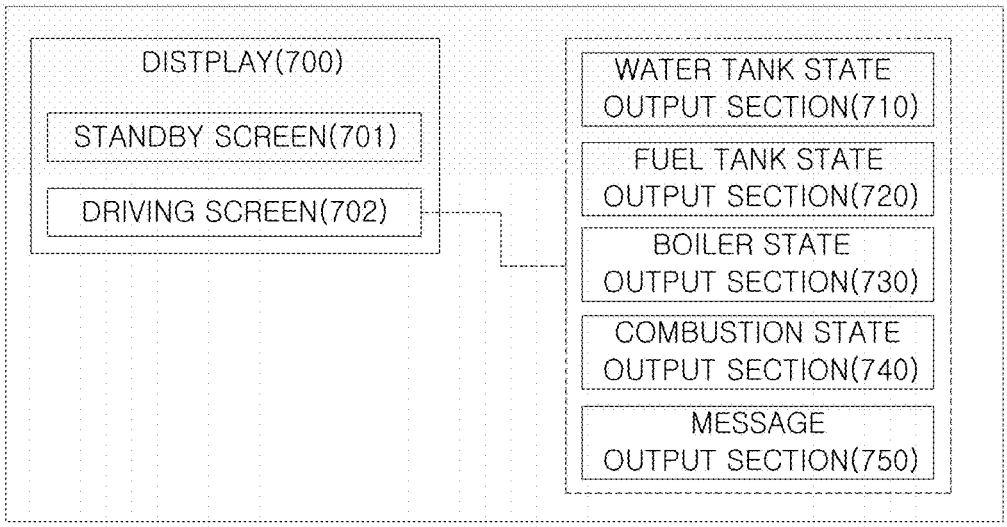
FIG. 2 is a block diagram illustrating configurations of a display and a driving screen output on the display.

In the attention requiring situation, message "ATTENTION REQUIRED" is output as illustrated in FIG. 2, and the attention requiring situation includes a situation where the water tank 100 is being charged or a situation where the fuel tank 200 is being charged.

In the wait requiring situation, message "PLEASE WAIT" is output as illustrated in FIG. 6, and the wait requiring situation includes a situation where both the water tank 100 and the fuel tank 200 are in the normal state and the boiler tank 300 is being charged or the burner 400 is on-combustion.

In the steam preparation completion situation, message "STEAM READY" is output as illustrated in FIG. 16, and the steam preparation completion situation corresponds to a situation where all of the water tank 100, the fuel tank 200, the boiler tank 300, and the burner 400 are in the normal state.

The error code message 752 is formed of a message outputting an error code according to a situation when an error situation is detected in the boiler tank 300 or the burner 400.

The error code according to each situation may be output as represented in Table 1 below (see FIGS. 19 to 29).

TABLE 1

| Error code | Error state | Driving situation | Display 700 |
|---|---|---|---|
| DW01 | The water level sensor 310 of the boiler tank 300 is in an error state. | The pump 320 is being operated, but water is not detected by the water level sensor 310 during the driving of the steam generating device. | The water level error icon 735 is output in the boiler state output section 730. |
| DW02 | The water level sensor 310 of the boiler tank 300 is in an error state. | Only a high water level is detected by the water level sensor 310 and a low water level is not detected during an initial operation or the driving of the steam generating device. | The water level error icon 735 is output in the boiler state output section 730. |
| DW03 | The state where a water level of the boiler tank 300 is exceeded. | The reference pressure value is measured in the pressure switch 340 during the operation of the air purge 350 and the pump 320. | The water level error icon 735 is output in the boiler state output section 730. |
| DS11 | The pressure switch 340 of the boiler tank 300 is in an error state. | The reference pressure value is measured in the pressure switch 340 in the state where the air purge 350 is being operated and the pump 320 is not operated. | The pressure switch error icon 744 is output in the combustion state output section 740. |
| DF41 | The flame detecting sensor 440 of the burner 400 is in an error state. | The air blowing fan 410 of the burner 400 is being operated and a low water level or a high water level is detected by the water level sensor 310 of the boiler tank 300, but flame is not detected by the flame detecting sensor 440 of the burner 400. | The flame detection error icon 745 is output in the combustion state output section 740. |
| DF42 | The flame detecting sensor 440 of the burner 400 is in an error state. | Water is not detected by the water level sensor 310 of the boiler tank 300, but flame is detected by the flame detecting sensor 440 of the burner 400. | The flame detection error icon 745 is output in the combustion state output section 740. |
| DP21 | The pump 320 of the boiler tank 300 is in an error state. | In the case where the operation time of the pump 320 exceeds a predetermined time in an initial charging state, in which water is not detected by the water level sensor 310 of the boiler tank 300, and a temperature value equal to or lower than 100° C. is measured by the thermistor 330. | The pump error icon 736 is output in the boiler state output section 730. |
| DP22 | The pump 320 of the boiler tank 300 is in an error | In the case where the operation time of the pump 320 exceeds a predetermined time in a recharging state, in which a low | The pump error icon 736 is output in the boiler state output section 730. |

TABLE 1-continued

| Error code | Error state | Driving situation | Display 700 |
|---|---|---|---|
| | state. | water level s detected by the water level sensor 310 of the boiler tank 300 and a temperature value equal to or higher than 100° C. is measured by the thermistor 330. | |
| DT31 | The thermistor 330 of the boiler tank 300 is in an error state. | A temperature below zero is detected by the thermistor 330. | The thermistor error icon 737 is output in the boiler state output section 730. |
| DT32 | The thermistor 330 of the boiler tank 300 is in an error state. | A temperature of 300° C. or higher is detected by the thermistor 330. | Each of the normal state icons (711, 721, 731, and 741) is output. |
| DT33 | The boiler tank 300 is in an overheated state. | A temperature in a range of 200□ to 250□ is detected by the thermistor 330. | The thermistor error icon 737 is output in the boiler state output section 730. |

For each of the error codes, a detailed phenomenon description, a reason of the phenomenon, and a measure according to each error code may be guided by a manual separately provided to the user and the like.

In the meantime, in addition to the message, the temperature value measured by the thermistor 330 of the boiler tank 300 may be output in real time on the message output section 750 (T in FIG. 13), or an operation state of the air purge 350 or the air blowing fan 410 may be displayed on the message output section 750 in the form of an icon (P of FIG. 13 is an icon of the air purge, and F is an icon output when the air blowing fan is driven) to enable the user to check the operation situation of the steam generating device 10 in real time.

Figure 30:
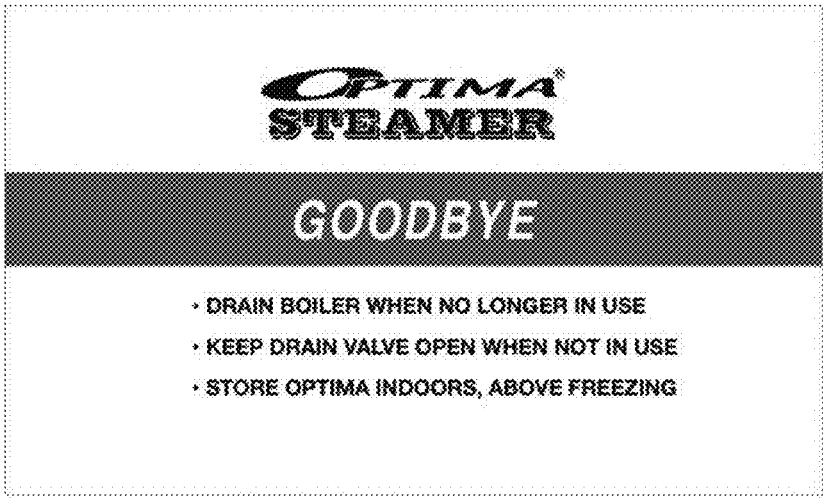
FIG. 30 is a diagram of an example of an exit screen.

When the driving of the steam generating device is stopped, the termination of the driving of the steam generating device and the matters to be attended in storage of the steam generating device are output in the form of the message while the exit screen 703 is output as illustrated in FIG. 30, thereby drawing the user's attention.

The foregoing configuration is related to the combustion-type boiler, which burns fuel and generates steam, and the electric boiler, which generates steam by heat generated by electricity does not require a fuel tank, so that in the electric boiler, the water tank state output section 710 may be output instead of the fuel tank state output section 720. Further, an icon output in the combustion state output section 740 may also be formed of a standby state icon 742*e* and an on-heating icon 743*e* in accordance with the electric type as illustrated in FIGS. 31 and 32. On a driving screen 702*e* of the electric boiler, an icon related to the driving of the air blowing fan may be omitted.

Further, regarding the error code, DF41 and DF42 corresponding to the error codes related to the burner 400 are not applicable to the electric type boiler.

The foregoing present invention is not limited to the exemplary embodiment and the accompanying drawings, and it may be apparent to those skilled in the art that the present invention may be variously substituted, modified, and changed within the range of the technical spirit of the present invention.

What is claimed is:

1. A monitoring system for a steam generating device mounted with a display, the monitoring system comprising:

a water tank, which is provided with a water level sensor which measures a water level of stored water;

a burner, which generates heat;

a boiler tank, which receives water from the water tank and receives heat by the burner to generate steam, and is provided with a water level sensor measuring a water level of supplied water, a pump supplying water from the water tank, a thermistor measuring an internal temperature, a pressure switch measuring an internal pressure, and an air purge discharging condensed air inside a boiler when a temperature measured by the thermistor is equal to or lower than a reference temperature; and the display, on which a screen monitoring driving situations of the water tank, the boiler tank, and the burner is output, wherein the burner is a burner generating heat by combustion of fuel or a heater generating heat by electricity, the water level sensor is formed of a high-water level sensor and a low-water level sensor vertically disposed inside the boiler tank, the display includes:

a standby screen output in a standby state, in which power is applied to the steam generating device and the system is not booted; and a driving screen output in a driving state, in which power is applied to the steam generating device and the system is booted, the driving screen includes:

a water tank state output section outputting a water charging state of the water tank according to the water level sensor of the water tank;

a boiler state output section outputting a water charging state of the boiler tank according to the water level sensor of the boiler tank and outputting an error state when an abnormal state is detected by the water level sensor or the thermistor of the boiler tank;

a combustion state output section outputting a state of the burner, and outputting an error state when an abnormal state is detected by the pressure switch of the boiler tank; and a message output section outputting a message or an error code according to a driving situation of the steam generating device, an icon output in the water tank state output section includes:

a normal state icon indicating a normal state when water is detected by the water level sensor of the water tank; and a refill request icon indicating a state, in which water is not detected by the water level sensor of the water tank and water charging is required, an icon output in the boiler state output section includes:

a standby state icon indicating a standby state, in which water is not detected by the water level sensor of the water tank, water is not detected by the high-water level sensor of the boiler tank, and a pump is not operated;

a charging state icon indicating that the pump is continuously operated in a state where water is detected by the water level sensor of the water tank and water is detected by the low-water level sensor of the boiler tank, so that the boiler tank is in a charging state until water is detected by the high-water level sensor of the boiler tank;

a normal state icon indicating a normal state, in which water is detected by the high-water level sensor of the boiler tank and an operation of the pump is stopped;

a recharging state icon indicating a recharging state, in which the pump is operated and the air purge is not operated in a state where water is detected by the water level sensor of the water tank, water is detected by the low-water level sensor of the boiler tank, and water is not detected by the high-water level sensor;

a water level error icon indicating that the water level sensor is in an error state when a low water level or a high water level is not detected in a situation where a low water level or a high water level needs to be detected;

a pump error icon indicating that an operation time of the pump is exceeded when the pump is continuously operated in a situation where the operation of the pump needs to be stopped; and a thermistor error icon indicating that the steam generating device has abnormality when a temperature value measured by the thermistor deviates from a normal range, an icon output in the combustion state output section includes:

a normal state icon indicating that the internal pressure of the boiler tank is in a normal state when it is measured that a pressure of the pressure switch reaches a reference pressure value, so that the pressure switch is operated (off state);

a standby state icon indicating that the burner is in a standby state when water is not detected by the water level sensor of the boiler tank, or an error is detected in the water level sensor or the thermistor of the boiler tank; and a pressure switch error icon indicating that the pressure switch is in an error state when the reference pressure value is measured in a state where a temperature of the thermistor is low, a message output from the message output section includes:

a situation notification message formed of messages notifying a situation of the steam generating device including an attention requiring situation, a wait requiring situation, and a steam preparation completion situation; and an error code message outputting an error code according to a situation when an error situation is detected in the boiler tank or the burner, entire accumulated hours, for which the steam generating device is booted and is used, are displayed on the standby screen, a temperature value measured by the thermistor of the boiler tank and an operation state of the air purge are displayed on the message output section in the form of an icon, when the pump is being operated, but water is not detected by the water level sensor during an operation of a steam boiler, the water level error icon is output on the boiler state output section and an error code according to the water level error icon is output on the message output section, when only a high water level is detected by the water level sensor, but a low water level is not detected during an initial operation or driving of the steam boiler, the water level error icon is output on the boiler state output section and an error code according to the water level error icon is output on the message output section, when the air purge and the pump are being operated, but the reference pressure value is measured by the pressure switch, the water level error icon is output on the boiler state output section and an error code according to the water level error icon is output on the message output section, when the air purge is being operated and the pump is not operated, but the reference pressure value is measured by the pressure switch, the pressure switch error icon is output on the combustion state output section and an error code according to the pressure switch error icon is output on the message output section, when water is not detected by the water level sensor of the boiler tank and the operation of the pump exceeds a predetermined time in an initial charging state, in which a temperature value equal to or smaller than a reference value is measured by the thermistor, the pump error icon is output on the boiler state output section and an error code according to the pump error icon is output on the message output section, when a low water level is detected by the water level sensor of the boiler tank and the operation of the pump exceeds the predetermined time in a recharging state, in which a temperature value equal to or larger than the reference value is measured by the thermistor, the pump error icon is output on the boiler state output section and an error code according to the pump error icon is output on the message output section, when a temperature below zero is detected by the thermistor, the thermistor error icon is output on the boiler state output section and an error code according to the thermistor error icon is output on the message output section, when a temperature equal to or higher than 300° C. is detected by the thermistor, the normal state icons and error codes according to the normal state icons are output on the message output section, when a temperature in a range of 200° C. to 250° C. is detected by the thermistor, the thermistor error icon is output on the boiler state output section and an error code according to the thermistor error icon is output on the message output section, the attention requiring situation of the situation notification message includes a situation where the water tank is being charged or the fuel tank is being charged, the standby requiring situation of the situation notification message includes a situation where both the water tank and the fuel tank are in the normal state and the boiler tank is being charged or the burner is being operated, and the steam preparation completion situation of the situation notification message includes a situation where all of the water tank, the fuel tank, the boiler tank, and the burner are in the normal state.

2. The monitoring system of claim 1, wherein the burner is a combustion type, and is provided with an air blowing fan, which discharges exhaust gas generated during combustion and a flame detecting sensor, which detects flame during combustion, the icon output in the combustion state output section further includes:

an on-combustion icon indicating on-combustion when the burner combusts fuel and heats the boiler tank; and a flame detection error icon indicating that the flame detecting sensor is in an error state when flame is not detected by the flame detecting sensor of the burner during the combustion or flame is detected during non-combustion, when the air blowing fan of the burner is being operated and a low water level or a high water level is detected by the water level sensor of the boiler tank, but flame is not detected by the flame detecting sensor of the burner, the flame detection error icon is output on the combustion state output section and an error code according to the flame detection error icon is output on the message output section, and when water is not detected by the water level sensor of the boiler tank, but flame is detected by the flame detecting sensor of the burner, the flame detection error icon is output on the combustion state output section and an error code according to the flame detection error icon is output on the message output section.

3. The monitoring system of claim 2, wherein when the temperature measured by the thermistor is equal to or lower than 80° C. at an initial driving, or the steam generating device is being cooled after the driving for a predetermined time, not at the initial driving, or the boiler tank is in a charging state, a valve is opened by the air purge, and when the temperature measured by the thermistor is equal to or higher than 80° C. in the state where the pressure measured by the pressure switch increases, the valve is blocked by the air purge.

* * * * *